US010544969B2

(12) United States Patent
Jindou et al.

(10) Patent No.: US 10,544,969 B2
(45) Date of Patent: Jan. 28, 2020

(54) HEAT EXCHANGER AND AIR CONDITIONER

(71) Applicant: DAIKIN INDUSTRIES, LTD., Osaka-shi, Osaka (JP)

(72) Inventors: Masanori Jindou, Osaka (JP); Yoshio Oritani, Osaka (JP); Shun Yoshioka, Osaka (JP)

(73) Assignee: DAIKIN INDUSTRIES, LTD., Osaka-Shi, Osaka (JP)

( * ) Notice: Subject to any disclaimer, the term of this patent is extended or adjusted under 35 U.S.C. 154(b) by 0 days.

(21) Appl. No.: 15/565,980

(22) PCT Filed: Mar. 2, 2016

(86) PCT No.: PCT/JP2016/001120
§ 371 (c)(1),
(2) Date: Oct. 12, 2017

(87) PCT Pub. No.: WO2016/174802
PCT Pub. Date: Nov. 3, 2016

(65) Prior Publication Data

US 2018/0112897 A1 Apr. 26, 2018

(30) Foreign Application Priority Data

Apr. 27, 2015 (JP) ..... 2015-089966

(51) Int. Cl.
*F28D 1/053* (2006.01)
*F28D 1/04* (2006.01)
(Continued)

(52) U.S. Cl.
CPC ..... *F25B 39/02* (2013.01); *F25B 13/00* (2013.01); *F28D 1/0435* (2013.01);
(Continued)

(58) Field of Classification Search
CPC ..... F25B 39/02; F25B 39/028; F25B 39/04; F25B 2339/04; F25B 2339/045;
(Continued)

(56) References Cited

U.S. PATENT DOCUMENTS

2013/0292098 A1* 11/2013 Jindou ..... F28F 13/06 165/143
2013/0306285 A1* 11/2013 Jindou ..... F25B 39/00 165/173
(Continued)

FOREIGN PATENT DOCUMENTS

JP 62-12464 U 1/1967
JP 2001-336896 A 12/2001
(Continued)

OTHER PUBLICATIONS

International Search Report, issued in PCT/JP2016/001120 (PCT/ISA/210), dated May 24, 2016.
(Continued)

*Primary Examiner* — Nelson J Nieves
(74) *Attorney, Agent, or Firm* — Birch, Stewart, Kolasch & Birch, LLP

(57) ABSTRACT

A plurality of refrigerant channels are grouped into two or more sets of refrigerant channels arranged in an air flow direction, and the two or more sets of refrigerant channels. When the heat exchanger functions as an evaporator, the refrigerants in a pair of the sets of refrigerant channels adjacent to each other in the air flow direction flow in parallel with each other in opposite directions.

11 Claims, 15 Drawing Sheets

(51) Int. Cl.

| | |
|---|---|
| ***F28D 1/047*** | (2006.01) |
| ***F25B 39/02*** | (2006.01) |
| ***F25B 13/00*** | (2006.01) |
| ***F28F 9/02*** | (2006.01) |
| *F28F 1/02* | (2006.01) |
| *F28F 1/32* | (2006.01) |
| *F28D 21/00* | (2006.01) |

(52) U.S. Cl.
CPC ..... *F28D 1/0471* (2013.01); *F28D 1/053* (2013.01); *F28D 1/05391* (2013.01); *F28F 9/0202* (2013.01); *F28F 9/0275* (2013.01); *F25B 2339/0242* (2013.01); *F28D 2021/0068* (2013.01); *F28F 1/022* (2013.01); *F28F 1/325* (2013.01); *F28F 2215/12* (2013.01)

(58) Field of Classification Search
CPC ..... F25B 2339/043; F28D 1/0471; F28D 1/0435; F28D 1/05391; F28F 9/0202; F28F 9/0275
See application file for complete search history.

(56) References Cited

U.S. PATENT DOCUMENTS

2014/0338874 A1* 11/2014 Jindou ..... F28F 9/0204 165/173
2015/0143835 A1* 5/2015 Matsumoto ..... F25B 40/02 62/324.1
2015/0260458 A1* 9/2015 Goel ..... F28D 1/05391 165/96
2015/0276280 A1* 10/2015 Furui ..... F25B 13/00 62/160
2015/0300744 A1* 10/2015 Goel ..... F28F 9/028 165/166
2015/0354838 A1* 12/2015 Cur ..... F24F 1/0003 62/426
2016/0054010 A1* 2/2016 Suhara ..... F24F 1/0007 62/426
2016/0169586 A1 6/2016 Ito et al.
2016/0238322 A1* 8/2016 Inoue ..... F25B 13/00
2016/0273817 A1* 9/2016 Makino ..... F25B 13/00
2016/0290730 A1* 10/2016 Taras ..... F28D 1/0435
2017/0082332 A1* 3/2017 Onaka ..... F25B 1/00
2017/0089642 A1* 3/2017 Taras ..... F28D 1/05391
2017/0241684 A1* 8/2017 Ito ..... F25B 39/00
2017/0307305 A1* 10/2017 Tanda ..... F28F 1/325
2017/0328614 A1* 11/2017 Yokozeki ..... F25B 39/00

FOREIGN PATENT DOCUMENTS

| | | | |
|---|---|---|---|
| JP | 2002-181488 | A | 6/2002 |
| JP | 2003-207294 | A | 7/2003 |
| JP | 2012-163326 | A | 8/2012 |
| JP | 2016-38192 | A | 3/2016 |
| KR | 10-2012-0024276 | A | 3/2012 |
| WO | WO 2015/025365 | A1 | 2/2015 |
| WO | WO 2015/025702 | A1 | 2/2015 |

OTHER PUBLICATIONS

Supplementary European Search Report, issued in EP 16786084.0, dated Nov. 6, 2018.

* cited by examiner

HEAT EXCHANGER AND AIR CONDITIONER

TECHNICAL FIELD

The present invention relates to a heat exchanger and an air conditioner.

BACKGROUND ART

Heat exchangers including multiple flat tubes arranged parallel to each other, and fins joined to the flat tubes have been known. Patent Document 1 discloses a heat exchanger of this type (see FIG. 2 of Patent Document 1). This heat exchanger is a single-bank heat exchanger in which flat tubes are arranged in a single bank in an air flow direction. The heat exchanger includes an upper heat exchange region (principal heat exchange region), and a lower heat exchange region (auxiliary heat exchange region). The number of the flat tubes in the lower heat exchange region is smaller than that in the upper heat exchange region.

Further, Patent Document 2 discloses a double-bank heat exchanger in which heat transfer tubes are arranged in two banks in the air flow direction (see FIG. 3 of Patent Document 2). In this heat exchanger (evaporator), a refrigerant in the heat transfer tubes constituting the first bank and a refrigerant in the heat transfer tubes constituting the second bank flow in opposite directions. Thus, in such a heat exchanger, a superheated region 17 is formed in the heat transfer tubes of the first bank to extend from a right end of the tubes toward, but not to reach, a left end in FIG. 3. In addition, in such a heat exchanger, another superheated region 17 is formed in the heat transfer tubes of the second bank to extend from a left end of the tubes toward, but not to reach, a right end in FIG. 3.

CITATION LIST

Patent Document

Patent Document 1: Japanese Unexamined Patent Publication No. 2012-163328

Patent Document 2 Japanese Examined Utility Model Publication No. S62-12464

SUMMARY OF THE INVENTION

Technical Problem

In the heat exchanger of Patent Document 2, as shown in FIG. 3, the superheated region 17 in the first bank and the superheated region 17 in the second bank overlap with each other in the air flow direction. Specifically, the superheated regions 17 overlap with each other in a transverse middle portion of the first and second banks. A liquid (wet) region 16 is formed near the left end of the first bank, while a liquid (wet) region 16 is formed near the right end of the second bank.

When the heat exchanger functions as an evaporator, the air is cooled to a low temperature in the wet regions 16. As a result, moisture in the air may sometimes be condensed to frost the surfaces of the heat transfer tubes and fins. If frosting occurs around the wet regions 16 in the first and second banks of the heat exchanger disclosed by Patent Document 2, the resistance of the air becomes lower in other regions in the heat exchanger than in the frosted region. Specifically, in the heat exchanger shown in FIG. 3, the superheated regions 17 are respectively formed in the transverse middle portions of the first and second banks, and overlap with each other. Thus, if the frosting occurs around the wet regions 16, the air tends to drift only toward the middle portion. The drift of the air leads to a decrease in the heat exchange efficiency of the heat exchanger.

In particular, in such a heat exchanger using the flat tubes as described in Patent Document 1, moisture condensed on the surfaces of the flat tubes tends to stagnate there, which easily frosts the surfaces of the flat tubes and fins. As a result, the above-described problem becomes remarkable.

In view of the foregoing background, it is therefore an object of the present invention to prevent, the drift of the air in a heat exchanger including two or more sets of refrigerant channels arranged adjacent to each other in an air flow direction in a situation where the heat exchanger functions as an evaporator, and to improve the heat exchange efficiency of the heat exchanger.

Solution to the Problem

A first aspect of the present invention is directed to a heat exchanger including: a plurality of flat tubes (31, 41) arranged parallel to each other, in each of which a plurality of refrigerant channels (C) are formed; and fins (32, 42) joined to the flat tubes (31, 41), the heat exchanger allowing a refrigerant flowing through each of the refrigerant channels (C) to exchange heat with air. The plurality of refrigerant channels (C) are grouped into two or more sets of refrigerant channels (C1, C2) arranged in an air flow direction. When the heat exchanger functions as an evaporator, the refrigerants in a pair of the sets of refrigerant channels (C1, C2) adjacent to each other in the air flow direction flow in parallel with each other in opposite directions.

According to the first aspect, two or more sets of refrigerant channels (C1, C2), each of which includes at least two refrigerant channels (C), are formed in each of the flat tubes (31, 41). The refrigerant flows through the refrigerant channels (C) in each of the sets of the refrigerant channels (C1, C2). When the heat exchanger functions as an evaporator, refrigerants in a pair of the sets of refrigerant channels (C1, C2) adjacent to each other in the air flow direction flow in parallel with each other. According to the present invention, the refrigerants in an adjacent pair of the sets of the refrigerant channels (C1, C2) flow in opposite directions.

Specifically, in a first set of refrigerant channels (C1), for example, a liquid refrigerant that has flowed into the flat tube (31) through one end thereof (e.g., a right end) exchanges heat with the air to gradually evaporate, and turns to a gas refrigerant. Thus, in the first set of refrigerant channels (C1), a superheated refrigerant region (S1) (through which a gas refrigerant flows) is formed around the other end (e.g., a left end) of the flat tube (31). On the other hand, in a second set of refrigerant channels (C2), for example, a liquid refrigerant that has flowed into the flat tube (41) through the other end thereof (e.g., a left end) exchanges heat with the air to gradually evaporate, and turns to a gas refrigerant. Thus, in the second set of refrigerant channels (C2), a gas refrigerant flows through a region around the one end (e.g., a right end) of the flat tube (41).

A second aspect of the present invention is an embodiment of the first aspect of the present invention. In the second aspect, superheated refrigerant regions (S1, S2) in an adjacent pair of the sets of refrigerant channels (C1, C2) do not overlap with each other in the air flow direction.

According to the present invention, the superheated refrigerant regions (S1, S2) in an adjacent pair of the sets of refrigerant channels (C1, C2) are located distant from each other, and do not overlap with each other in the air flow direction. Thus, unlike generally known heat exchangers, the biased drift of the air only toward the superheated refrigerant regions (S1, S2) can be prevented.

A third aspect of the present invention is an embodiment of the first or second aspect of the present invention. In the third aspect, the heat exchanger includes a plurality of banks (30, 40) arranged in the air flow direction, each including the plurality of flat tubes (31, 41) corresponding to the sets of refrigerant channels (C1, C2). When the heat exchanger functions as the evaporator, superheated refrigerant regions (S1, S2) in an adjacent pair of the sets of refrigerant channels (C1, C2) of the banks (30, 40) do not overlap with each other in the air flow direction.

According to the third aspect, the plurality of banks (30, 40) each including a plurality of flat tubes (31, 41) are arranged in the air flow direction. A set of refrigerant channels (C1, C2) is formed in each of the flat tubes (31, 41) of each bank (30, 40). When the heat exchanger functions as an evaporator, refrigerants in the sets of refrigerant channels (C1, C2) in a pair of the banks (30, 40) adjacent to each other in the air flow direction flow in parallel with each other.

According to the present invention, the refrigerants in the banks (30, 40) flow in opposite directions, and the superheated refrigerant regions (S1, S2) respectively formed in the sets of refrigerant channels (C1, C2) of the banks (30, 40) do not overlap with each other in the air flow direction. Thus, the drift of the air can be prevented in a heat exchanger including the flat tubes (31, 41) arranged in two banks, for example.

A fourth aspect of the present invention is an embodiment of the first or second aspect of the present invention. In the fourth aspect, the heat exchanger includes a single bank (30) having the plurality of flat tubes (31) arranged parallel to each other, each of the flat tubes (31) including the two or more sets of refrigerant channels (C1, C2). When the heat exchanger functions as the evaporator, superheated refrigerant regions (S1, S2) in an adjacent pair of the sets of refrigerant channels (C1, C2) in the single bank (30) do not overlap with each other in the air flow direction.

According to the fourth aspect, two or more sets of refrigerant channels (C1, C2) adjacent to each other in the air flow direction are formed in each of the plurality of flat tubes (31) arranged parallel to each other in the single bank (30). When the heat exchanger functions as an evaporator, refrigerants in a pair of the sets of refrigerant channels (C1, C2) adjacent to each other in the air flow direction flow in parallel with each other.

According to the present invention, the refrigerants in the adjacent sets of refrigerant channels (C1, C2) in the single bank (30) flow in opposite directions, and the superheated refrigerant regions (S1, S2) formed in the adjacent sets of refrigerant channels (C1, C2) do not overlap with each other in the air flow direction. Thus, the drift of the air can be prevented in a heat exchanger including two or more sets of refrigerant channels (C1, C2) formed in each of the flat tubes (31) constituting a single bank.

A fifth aspect of the invention is an embodiment of any one of the first to fourth aspects of the present invention. In the fifth aspect, the plurality of flat tubes (31, 41) are vertically arranged, each of the flat tubes (31, 41) has three bent portions (33*a*, 33*b*, 33*c*, 43*a*, 43*b*, 43*c*), and four side surfaces (23*a*, 23*b*, 23*c*, 23*d*) through which the air passes are formed by the plurality of flat tubes (31, 41).

According to the fifth aspect, each of the vertically arranged flat tubes (31, 41) has three bent portions (33*a*, 33*b*, 33*c*). Thus, four side surfaces (23*a*, 23*b*, 23*c*, 23*d*) are formed by the plurality of flat tubes (31, 41). That is, the heat exchanger is configured as a four-surface heat exchanger having the four side surfaces (23*a*, 23*b*, 23*c*, 23*d*) through which the air passes. The heat exchanger configured in this manner increases the axial length of the flat tubes (31, 41), thereby increasing the channel length of each set of the refrigerant channels (C1, C2) as well. Thus, in the adjacent sets of the refrigerant channels (C1, C2), a sufficient distance is provided between the superheated refrigerant regions (S1, S2). This can effectively prevent the superheated refrigerant regions (S1, S2) from overlapping with each other in the air flow direction.

A sixth aspect of the present invention is directed to an air conditioner (10) including a refrigerant circuit (20) which includes the heat exchanger (23) of any one of the first to fifth aspects of the present invention, and performs a refrigeration cycle. The air conditioner is switchable between an operation in which the heat exchanger (23) functions as an evaporator, and an operation in which the heat exchanger (23) functions as a condenser.

According to the sixth aspect, the heat exchanger (23) of any one of the first to fifth aspects is provided for the refrigerant circuit (20) of the air conditioner (10). When the heat exchanger (23) functions as an evaporator, the drift of the air in the heat exchanger (23) is reduced.

Advantages of the Invention

According to the present invention, the refrigerants in the adjacent sets of refrigerant channels (C1, C2) flow in parallel with each other. Thus, compared to the case where the refrigerants in the adjacent sets of refrigerant channels (C1, C2) flow in series, the total length of the refrigerant channels (C) is reduced, thereby reducing the flow velocity of the refrigerant as well. This can reduce the pressure loss in the refrigerant channels (C).

According to the second aspect, when the heat exchanger functions as an evaporator, the superheated refrigerant regions (S1, S2) in a pair of the sets of refrigerant channels (C1, C2) adjacent to each other in the air flow direction do not overlap with each other in the air flow direction. Thus, the biased drift of the air only toward the superheated refrigerant regions (S1, S2) can be prevented. As a result, even if frosting occurs on the surfaces of the flat tubes (31, 41) and fins (32, 42) other than the superheated refrigerant regions (S1, S2), the air can still flow uniformly throughout the heat exchanger. This improves the heat exchange efficiency, and eventually the evaporation performance, of the heat exchanger.

According to the third aspect, the advantages of the first aspect can be achieved in the configuration in which the set of refrigerant channels (C1, C2) is formed in each of the flat tubes (31, 41) of the two or more banks (30, 40).

According to the fourth aspect, the flat tubes (31, 41) are arranged in two or more banks. Thus, the width (length in the air flow direction) of the flat tubes (31, 41) can be relatively reduced. This facilitates bending of the flat tubes (31, 41) in the width direction. Reducing the width of the flat tubes (31, 41) allows the ventilation resistance between the flat tubes (31, 41) of each bank (30, 40) to be reduced, thus curbing a decline in thermal transmittance. Further, the decrease in the width of the flat tubes (31, 41) also precludes the possibility of condensed water stagnating on the flat tubes (31, 41). This substantially prevents the surfaces of the flat tubes (31, 41) from being frosted.

According to the fifth aspect, the advantages of the first or second aspect can be achieved in the configuration in which two or more sets of refrigerant channels (C1, C2) are formed in the single bank (30, 40). Moreover, according to the fifth aspect, the flat tubes (31) and the fins (32) are arranged only in a single bank. This reduces the parts count.

According to the sixth aspect, the heat exchanger is configured as a so-called "four-surface heat exchanger." Thus, the heat exchanger can be downsized, and the area of a heating surface that contributes to heat exchange between the air and the refrigerant can be ensured. Further, in the adjacent sets of refrigerant channels (C1, C2), a sufficient distance is ensured between the superheated regions (S1, S2). This can effectively prevent the superheated refrigerant regions (S1, S2) from overlapping with each other.

DETAILED DESCRIPTION

Embodiments of the present invention will be described in detail with reference to the drawings. The following embodiments are merely exemplary ones in nature, and are not intended to limit the scope, application, or uses of the invention.

A heat exchanger of the present embodiment is as an outdoor heat exchanger (23) provided in an air conditioner (10). The air conditioner (10) will now be described first, and then the outdoor heat exchanger (23) will be described in detail later.

<General Configuration of Air Conditioner>

Figure 1:
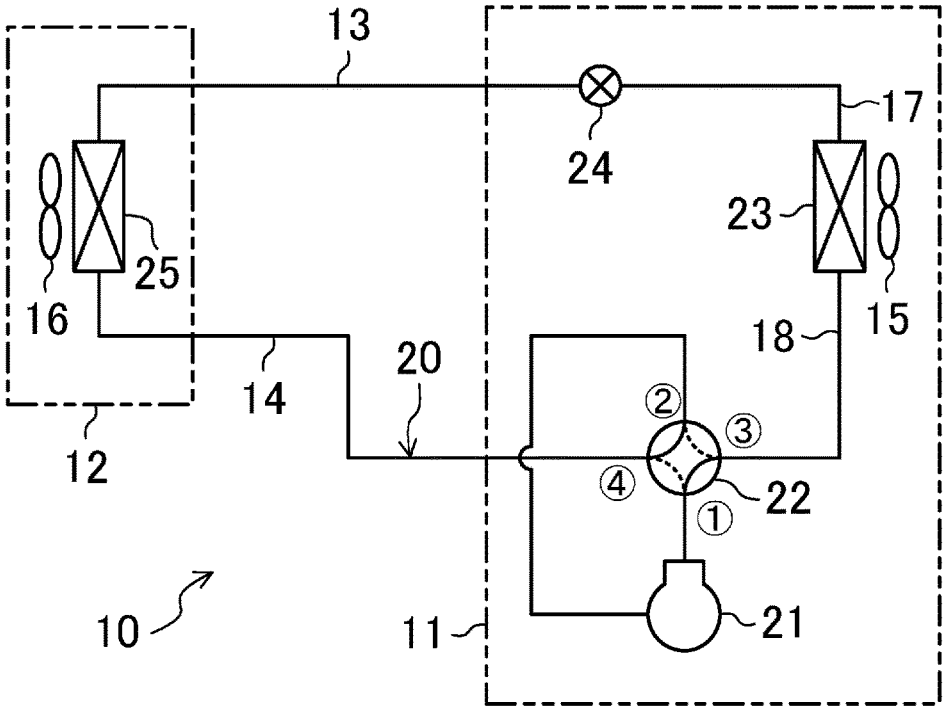
FIG. 1 is a refrigerant circuit diagram illustrating a general configuration of an air conditioner.

The air conditioner (10) will be described below with reference to FIG. 1.

The air conditioner (10) includes an outdoor unit (11) and an indoor unit (12). The outdoor and indoor units (11) and (12) are connected to each other via a liquid interconnecting pipe (13) and a gas interconnecting pipe (14). In this air conditioner (10), the outdoor unit (11), the indoor unit (12), the liquid interconnecting pipe (13), and the gas interconnecting pipe (14) are connected together to form a refrigerant circuit (20).

The refrigerant circuit (20) includes a compressor (21), a four-way switching valve (22), an outdoor heat exchanger (23), an expansion valve (24), and an indoor heat exchanger (25). The compressor (21), the four-way switching valve (22), the outdoor heat exchanger (23), and the expansion valve (24) are housed in the outdoor unit (11). The outdoor unit (11) is also provided with an outdoor fan (15) for supplying outdoor air to the outdoor heat exchanger (23). The indoor heat exchanger (25) is housed in the indoor unit (12). The indoor unit (12) is provided with an indoor fan (16) for supplying indoor air to the indoor heat exchanger (25).

The refrigerant circuit (20) is a closed circuit filled with a refrigerant. In the refrigerant circuit (20), the compressor (21) has a discharge pipe connected to a first port of the four-way switching valve (22), and a suction pipe connected to a second port of the four-way switching valve (22). In this refrigerant circuit (20), the outdoor heat exchanger (23), the expansion valve (24), and the indoor heat exchanger (25) are arranged in this order from a third port to a fourth port of the four-way switching valve (22). The outdoor heat exchanger (23) in the refrigerant circuit (20) is connected to the expansion valve (24) via a pipe (17), and to the third port of the four-way switching valve (22) via a pipe (18).

The compressor (21) is a hermetic scroll or rotary compressor. The four-way switching valve (22) switches between a first state in which the first port communicates with the third port, and the second port communicates with the fourth port (indicated by solid curves FIG. 1), and a second state in which the first port communicates with the fourth port, and the second port communicates with the third port (indicated by broken curves in FIG. 1). The expansion valve (24) is a so-called "electronic expansion valve."

The outdoor heat exchanger (23) allows outdoor air and a refrigerant to exchange heat. The outdoor heat exchanger (23) will be described in detail later. The indoor heat exchanger (25) allows indoor air and the refrigerant to exchange heat. The indoor heat exchanger (25) is configured as a so-called "cross-fin, fin-and-tube heat exchanger" including circular heat transfer tubes.

—Operation of Air Conditioner—

The air conditioner (10) selectively performs cooling operation and heating operation.

During the cooling operation, the refrigerant circuit (20) performs a refrigeration cycle with the four-way switching valve (22) set to the first state. In this state, the refrigerant circulates through the outdoor heat exchanger (23), the expansion valve (24), and the indoor heat exchanger (25) in this order, the outdoor heat exchanger (23) functions as a condenser, and the indoor heat exchanger (25) functions as an evaporator. In the outdoor heat exchanger (23), a gas refrigerant coming from the compressor (21) is condensed through dissipation of heat to the outdoor air. Then, the condensed refrigerant flows toward the expansion valve (24).

During the heating operation, the refrigerant circuit (20) performs a refrigeration cycle with the four-way switching valve (22) set to the second state. In this state, the refrigerant circulates through the indoor heat exchanger (25), the expansion valve (24), and the outdoor heat exchanger (23) in this order, the indoor heat exchanger (25) functions as a condenser, and the outdoor heat exchanger (23) functions as an evaporator. The refrigerant, which has expanded while passing through the expansion valve (24) and turned into a two-phase gas and liquid refrigerant, flows into the outdoor heat exchanger (23). The refrigerant that has flowed into the outdoor heat exchanger (23) evaporates through absorption of heat from the outdoor air, and then flows toward the compressor (21).

<General Configuration of Outdoor Heat Exchanger>

The outdoor heat exchanger (23) according to the embodiment will be described with reference to FIGS. 2 to 11 as needed. Note that the number of flat tubes (31, 41) described below is merely an example.

Figure 2:
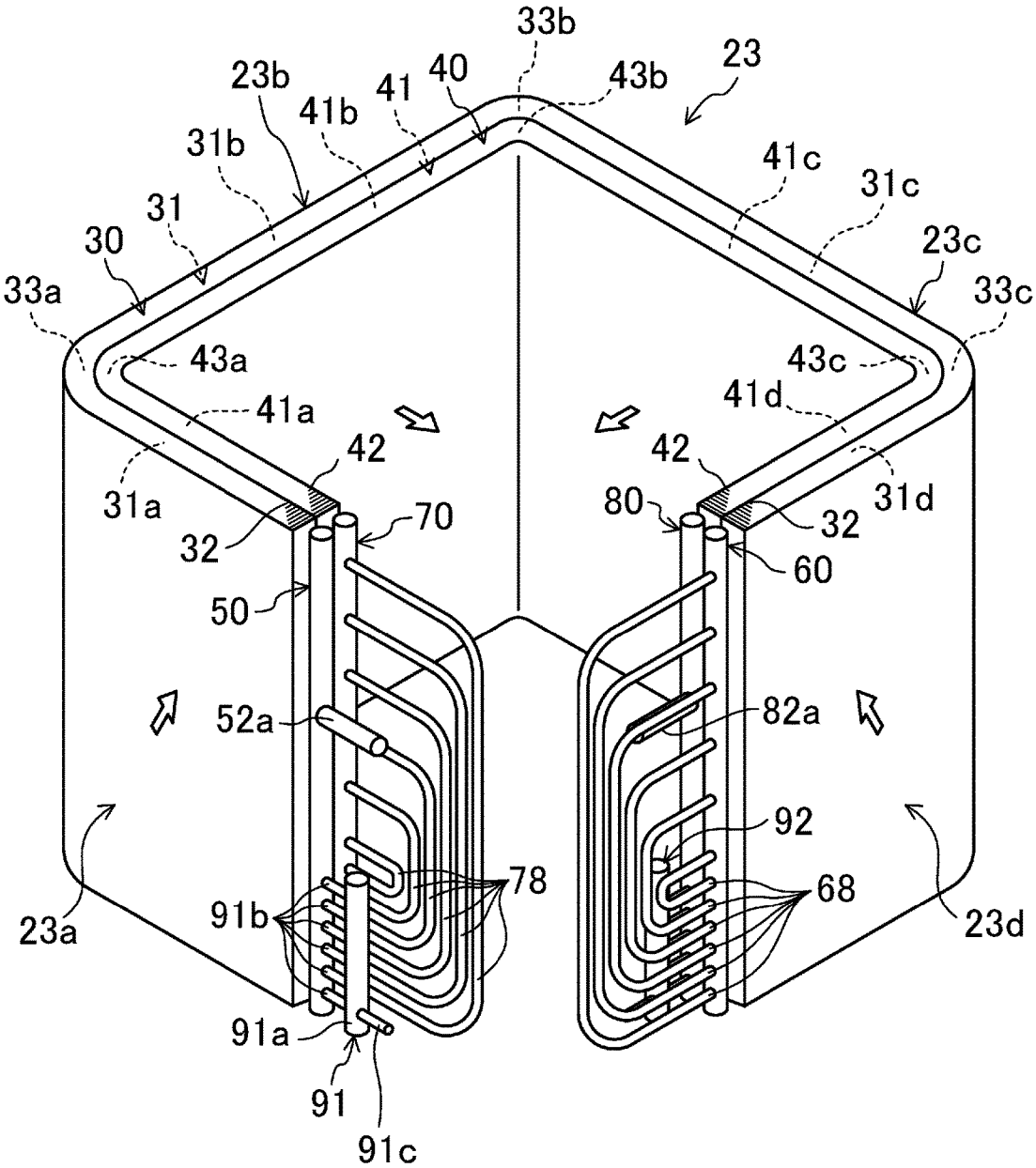
FIG. 2 is a schematic perspective view illustrating an outdoor heat exchanger.

As shown in FIG. 2, the outdoor heat exchanger (23) is a four-surface air heat exchanger having four side surfaces (23*a*, 23*b*, 23*c*, 23*d*). Specifically, the outdoor heat exchanger (23) includes a first side surface (23*a*), a second side surface (23*b*), a third side surface (23*c*), and a fourth side surface (23*d*), which are arranged continuously. Referring to FIG. 2, the first side surface (23*a*) is a lower left surface, the second side surface (23*b*) is an upper left surface, the third side surface (23*c*) is an upper right surface, and the fourth side surface (23*d*) is a lower right surface. The side surfaces (23*a*, 23*b*, 23*c*, 23*d*) have approximately the same height. The first and fourth side surfaces (23*a*) and (23*d*) have a smaller width than the second and third side surfaces (23*b*) and (23*c*).

When the outdoor fan (15) in the outdoor heat exchanger (23) is operated, the outdoor air outside of the side surfaces (23*a*, 23*b*, 23*c*, 23*d*) flows inward through the side surfaces (23*a*, 23*b*, 23*c*, 23*d*) as indicated by the arrows in FIG. 2. The air is exhausted through a blowout port formed in an upper portion of an outdoor casing (not shown).

Figure 3:
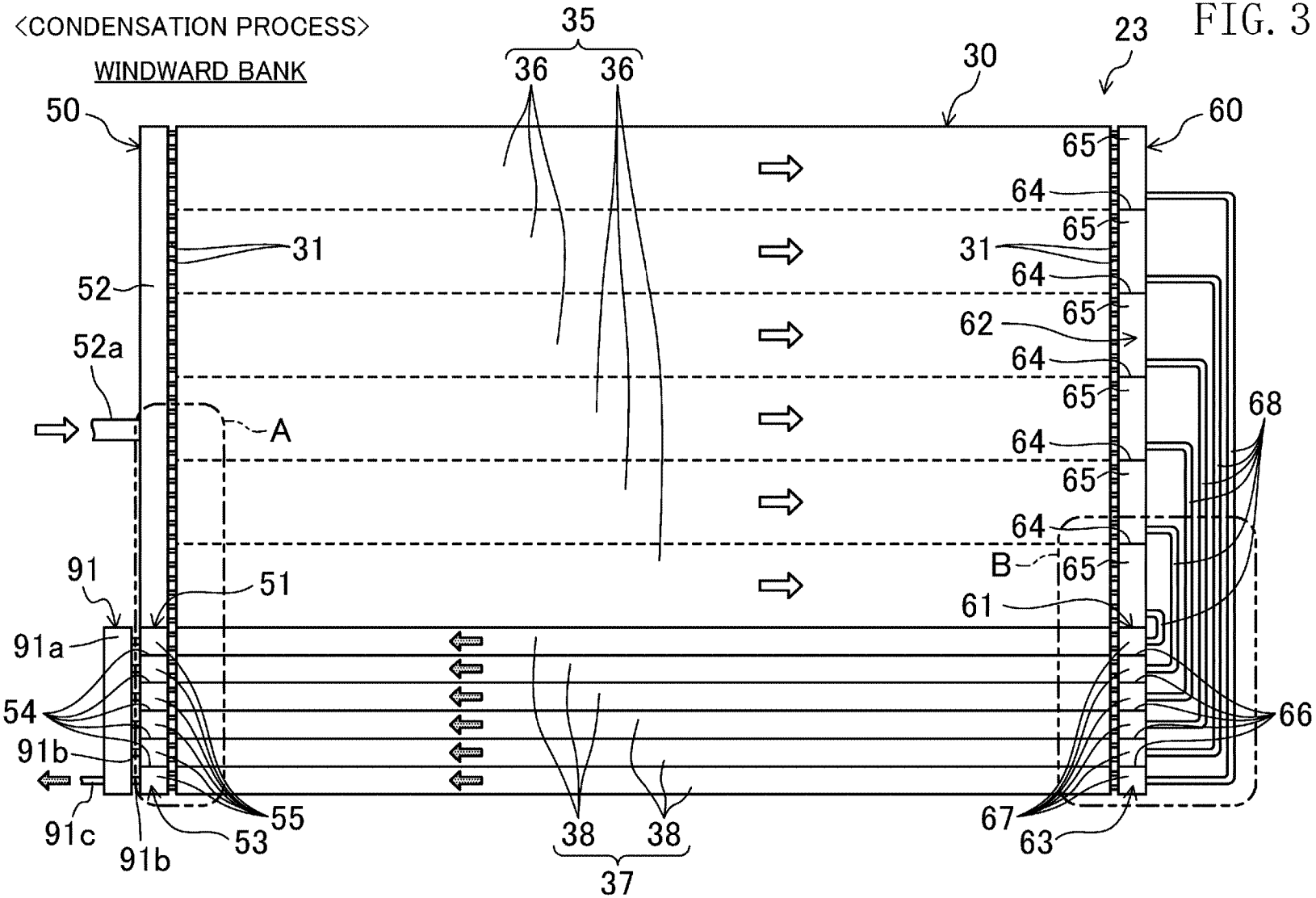
FIG. 3 is a schematic developed plan view showing the configuration of a windward bank of the outdoor heat exchanger, illustrating how a refrigerant flows when the heat exchanger functions as a condenser.
Figure 4:
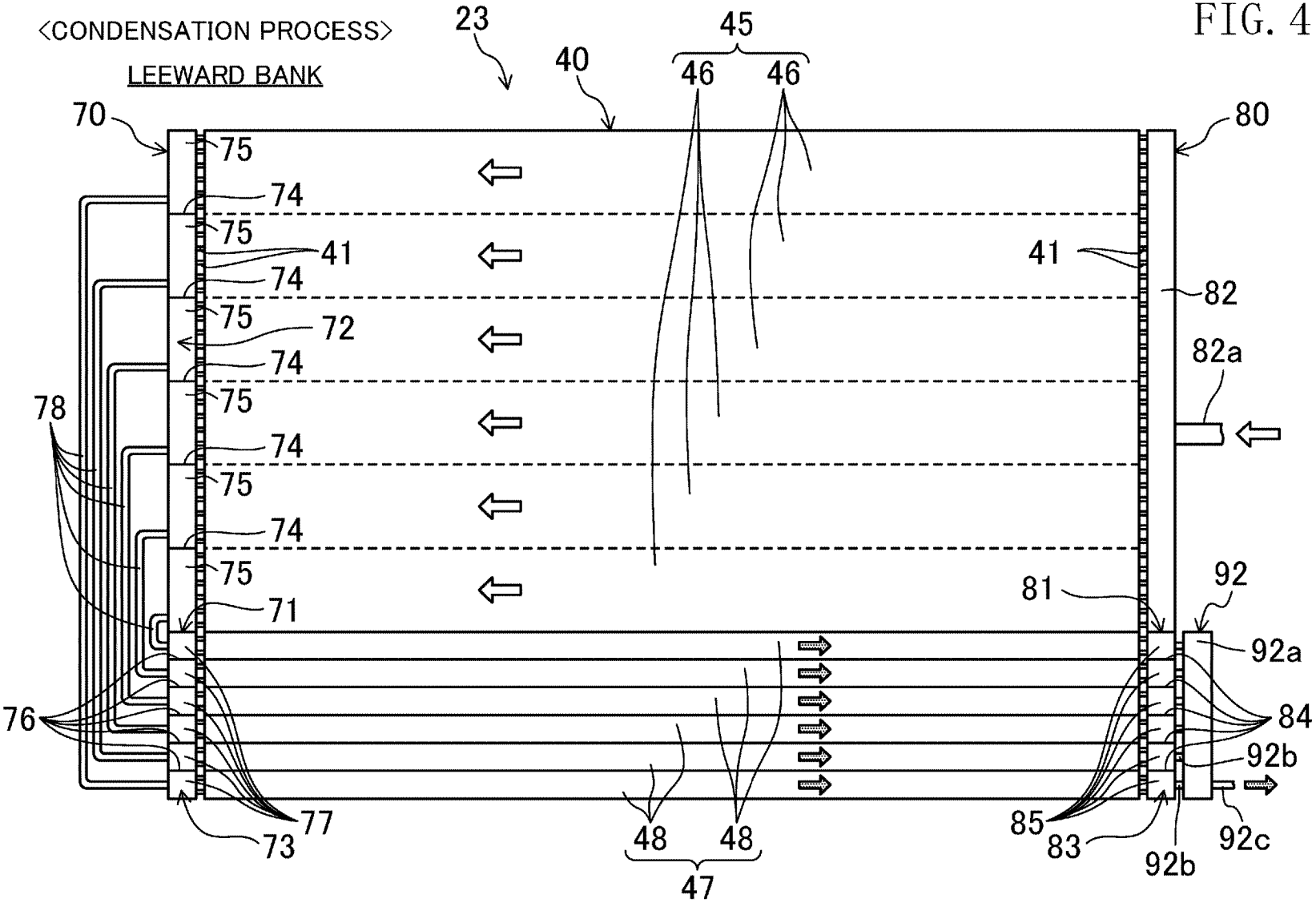
FIG. 4 is a schematic developed plan view showing the configuration of a leeward bank of the outdoor heat exchanger, illustrating how a refrigerant flows when the heat exchanger functions as a condenser.

As shown in FIGS. 2-4, the outdoor heat exchanger (23) is a double-bank heat exchanger including two banks (30, 40), each having flat tubes (31, 41) and fins (32, 42). Alternatively, the outdoor heat exchanger (23) may include three or more banks. In the outdoor heat exchanger (23) of the present embodiment, one of the two banks on the windward side in an air flow direction is configured as a windward bank (30), and the other bank on the leeward side is configured as a leeward bank (40). FIGS. 3 and 4 schematically show the windward and leeward banks (30) and (40) respectively developed in separate plan views.

The outdoor heat exchanger (23) includes a first header collecting pipe (50), a second header collecting pipe (60), a third header collecting pipe (70), a fourth header collecting pipe (80), a first divergence unit (91), and a second divergence unit (92). The first header collecting pipe (50) is arranged to stand upright near one end of the windward bank (30) adjacent to the first side surface (23*a*). The second header collecting pipe (60) is arranged to stand upright near the other end of the windward bank (30) adjacent to the fourth side surface (23*d*). The third header collecting pipe (70) is arranged to stand upright near one end of the leeward bank (40) adjacent to the first side surface (23*a*). The fourth header collecting pipe (80) is arranged to stand upright near the other end of the leeward bank (40) adjacent to the fourth side surface (23*d*). The first divergence unit (91) is arranged to stand upright near the first header collecting pipe (50). The second divergence unit (92) is arranged to stand upright near the fourth header collecting pipe (80).

The flat tubes (31, 41), the fins (32, 42), the first to fourth header collecting pipes (50, 60, 70, 80), and the first and second divergence units (91, 92) are all members made of an aluminum alloy, and are joined to one another by brazing.

[Windward Bank]

As shown in FIGS. 2, 3, and 5-10, the windward bank (30) includes multiple flat tubes (31) and multiple fins (32).

Figure 7:
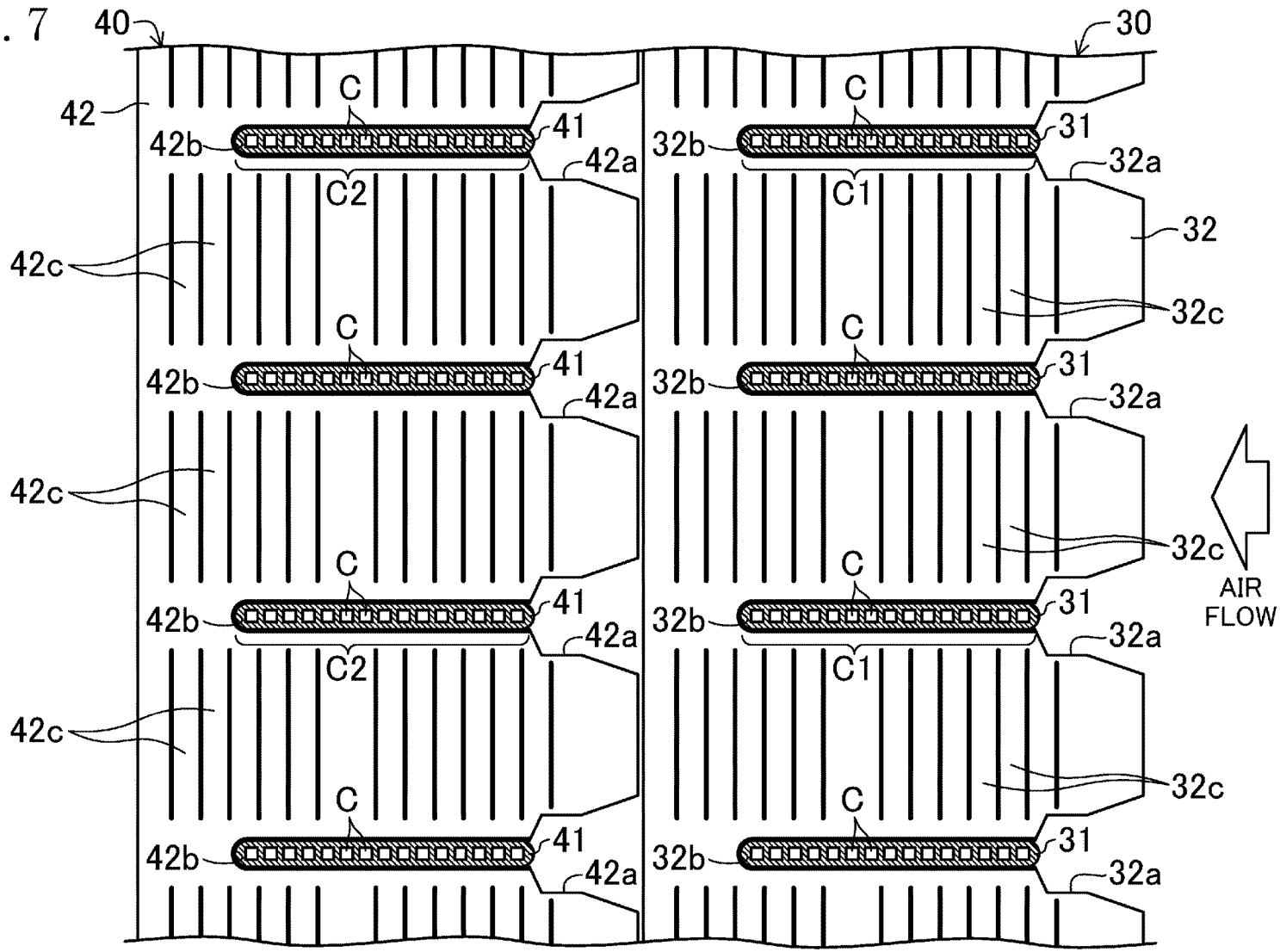
FIG. 7 is a cross-sectional view taken along a plane VII-VII of FIG. 5.
Figure 8:
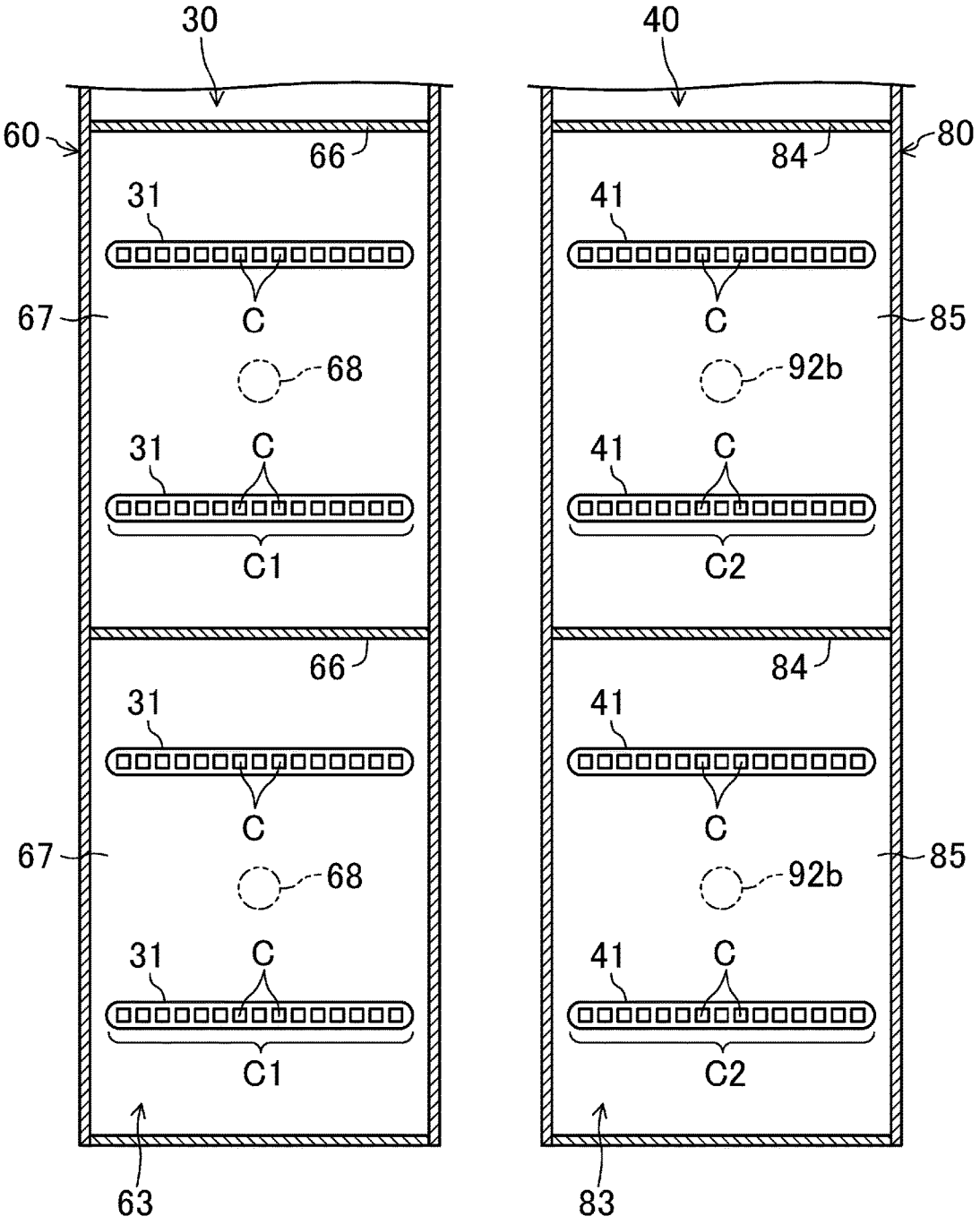
FIG. 8 is a cross-sectional view taken along the plane VIII-VIII of FIG. 6.
Figure 9:
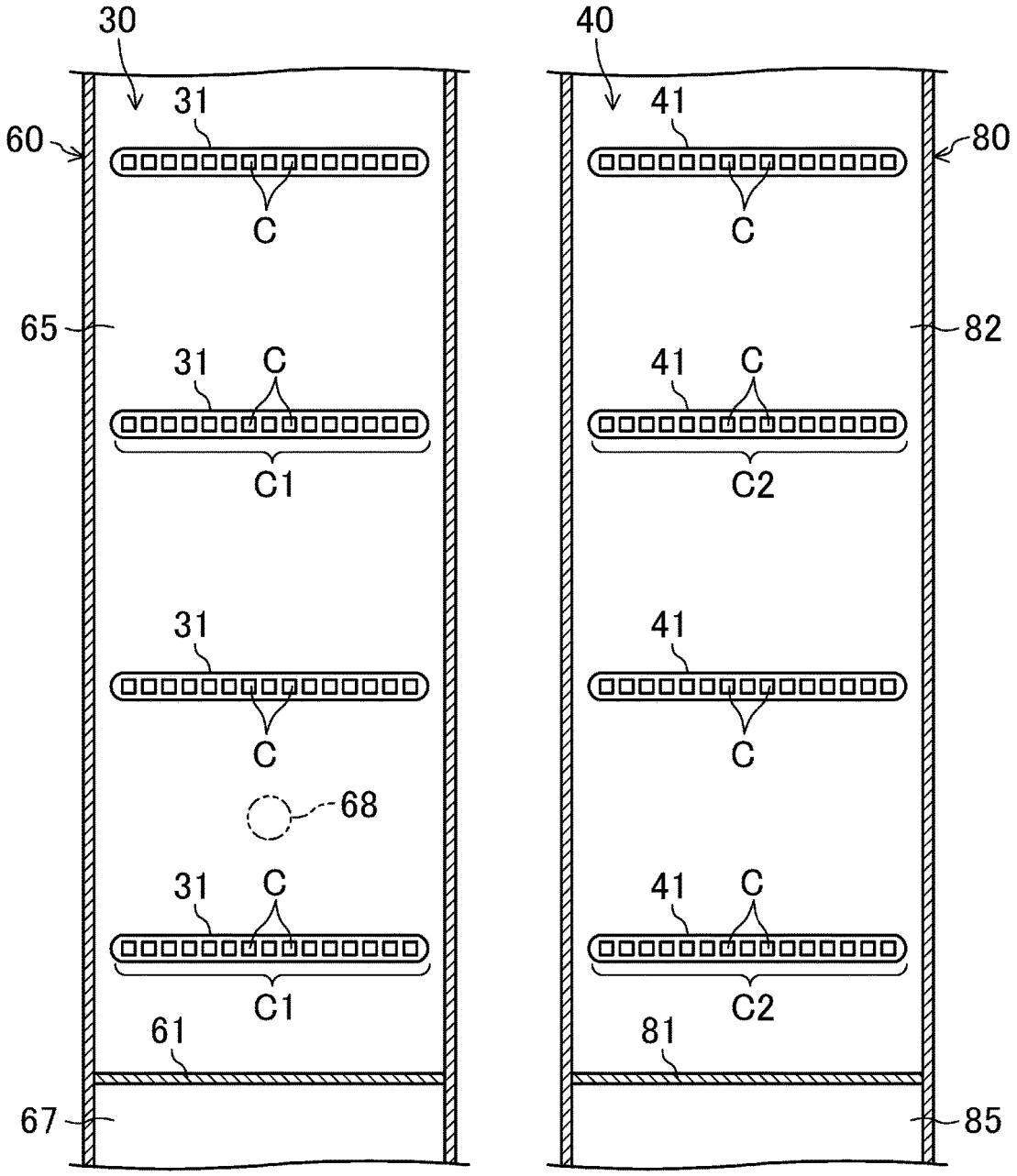
FIG. 9 is a cross-sectional view taken along the plane VIIII-VIIII of FIG. 6.
Figure 10:
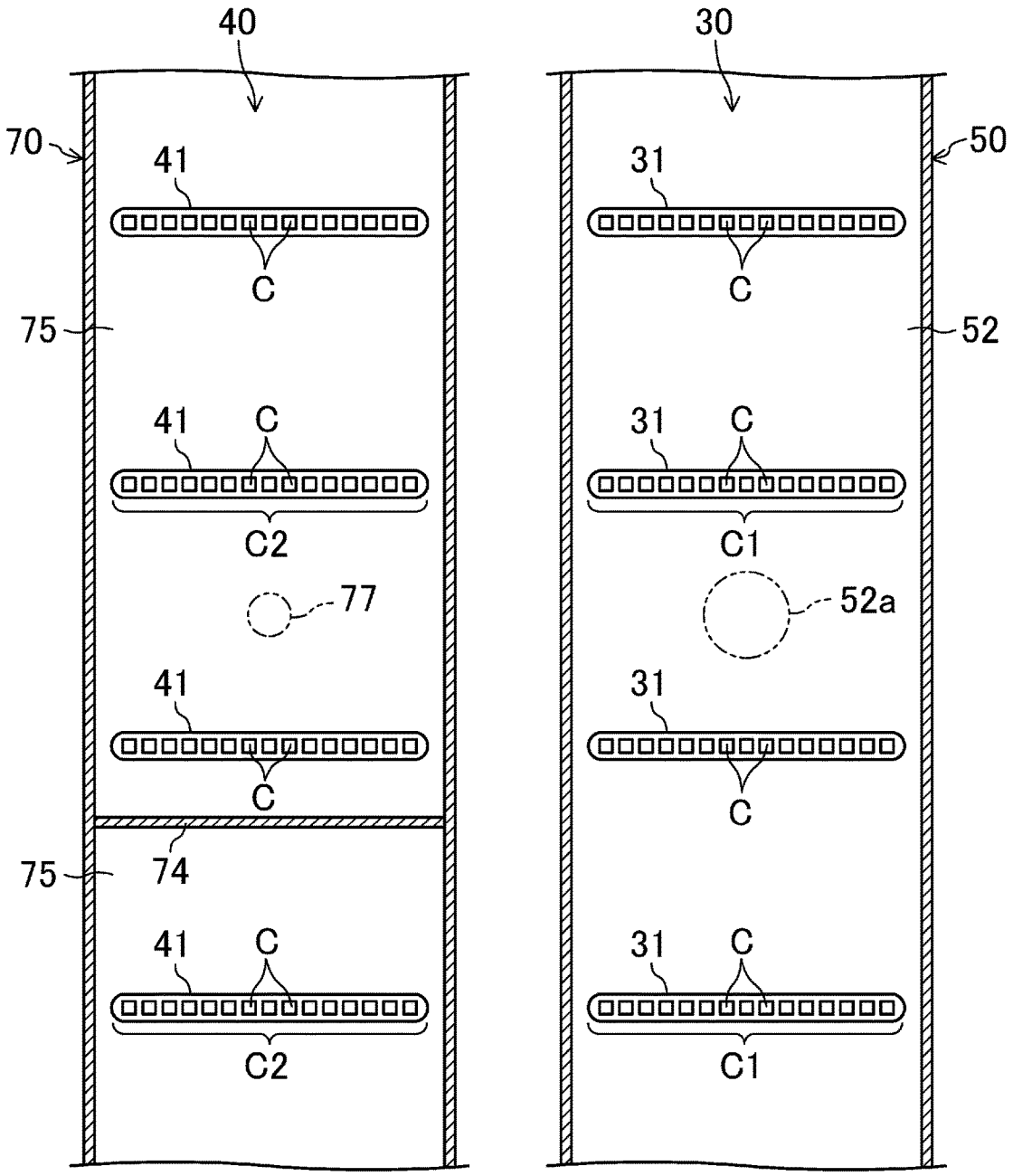
FIG. 10 is a cross-sectional view taken along the plane X-X of FIG. 5.

Each of the flat tubes (31) is a heat transfer tube having a flat, substantially oval cross section when viewed in a section cut along a plane perpendicular to its axis (see FIG. 7). The plurality of flat tubes (31) are arranged such that upper and lower flat surfaces of each of the flat tubes face those of adjacent flat tubes. That is, the plurality of flat tubes (31) are vertically arranged at regular intervals, with their axes extending substantially parallel to each other.

As shown in FIG. 2, each of the flat tubes (31) includes a first windward tube portion (31*a*) extending along the first side surface (23*a*), a second windward tube portion (31*b*) extending along the second side surface (23*b*), a third windward tube portion (31*c*) extending along the third side surface (23*c*), and a fourth windward tube portion (31*d*) extending along the fourth side surface (23*d*). Further, as shown in FIG. 2, the flat tube (31) includes a first windward bent portion (33*a*) which is bent horizontally at approximately right angles from the first windward tube portion (31*a*) toward the second windward tube portion (31*b*), a second windward bent portion (33*b*) which is bent horizontally at approximately right angles from the second windward tube portion (31*b*) toward the third windward tube portion (31*c*), and a third windward bent portion (33*c*) which is bent horizontally at approximately right angles from the third windward tube portion (31*c*) toward the fourth windward tube portion (31*d*).

Figure 5:
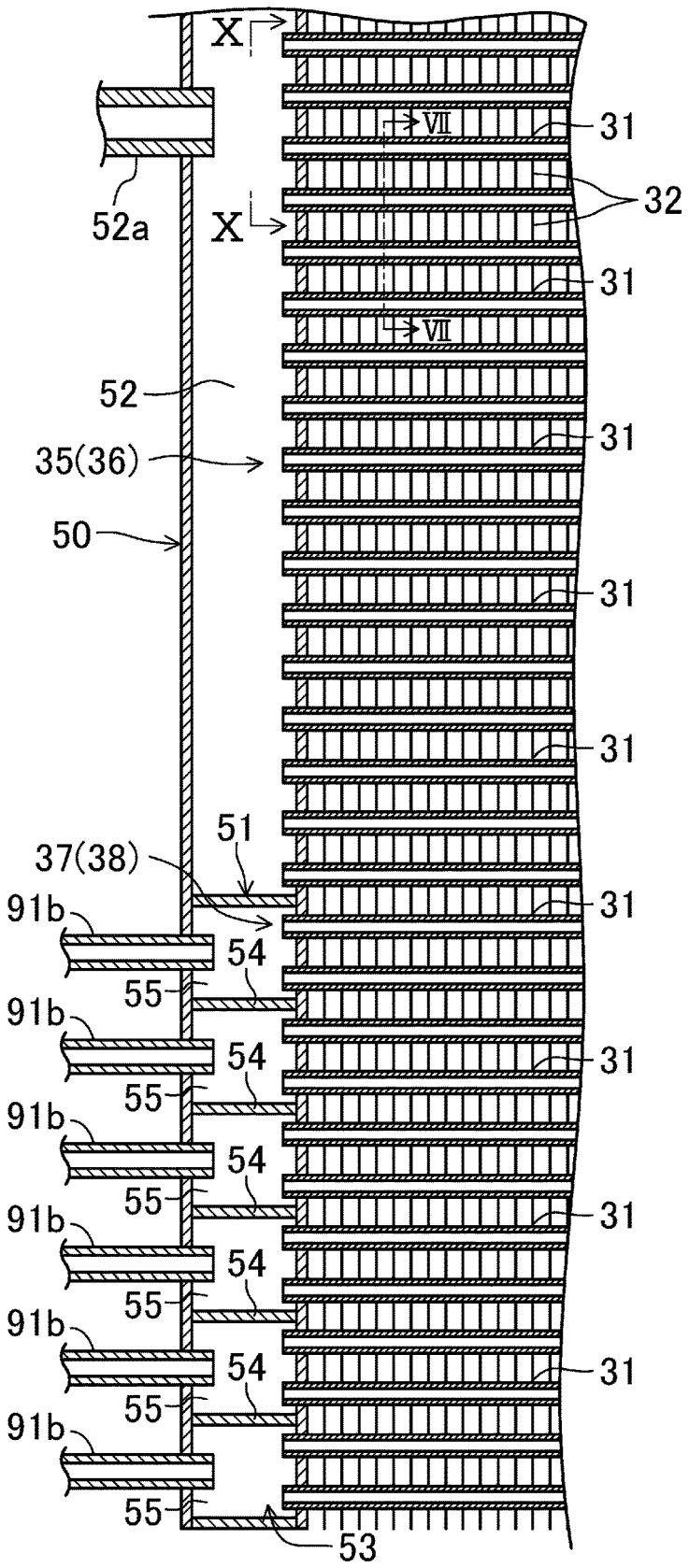
FIG. 5 is a vertical cross-sectional view illustrating a region A of FIG. 3 on an enlarged scale.
Figure 6:
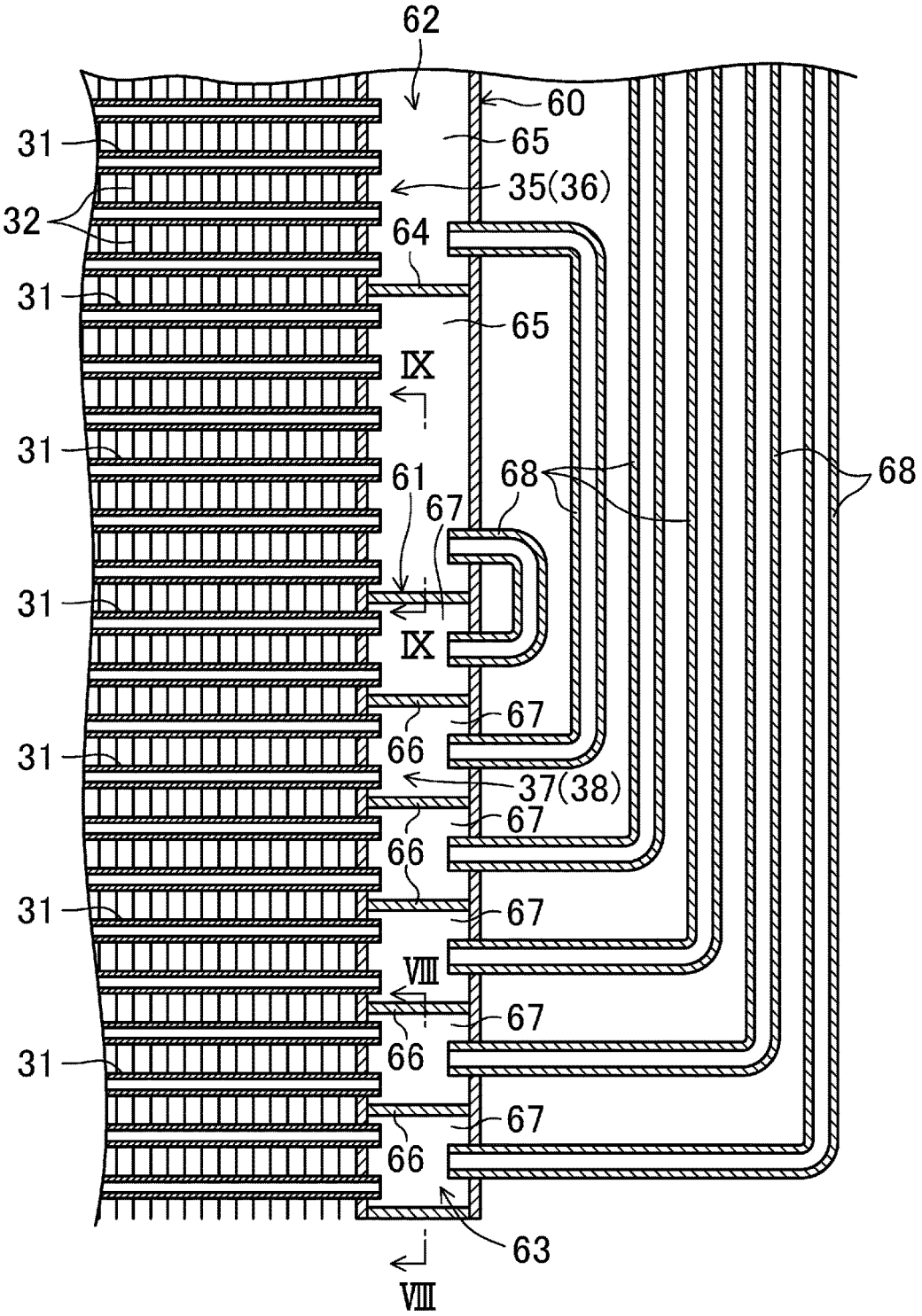
FIG. 6 is a vertical cross-sectional view illustrating a region B of FIG. 3 on an enlarged scale.

An end of the first windward tube portion (31*a*) of each of the flat tubes (31) is inserted in the first header collecting pipe (50) (see FIG. 5), and an end of the fourth windward tube portion (31*d*) of each of the flat tubes (31) is inserted in the second header collecting pipe (60) (see FIG. 6).

As shown in FIG. 7, a plurality of refrigerant channels (C) are formed in each of the flat tubes (31). The plurality of refrigerant channels (C) extend in the axial direction of the flat tubes (31), and are aligned in the width direction of the flat tubes (31) (an air flow direction). Each of the refrigerant channels (C) opens at both end faces of an associated one of the flat tubes (31). A refrigerant supplied to the windward bank (30) exchanges heat with air while flowing through the refrigerant channels (C) in the flat tubes (31). The plurality of refrigerant channels (C) in each of the flat tubes (31) of the windward bank (30) constitute a set of windward refrigerant channels (C1).

Each of the fins (32) is a vertically elongated plate fin formed by pressing a metal plate. The plurality of fins (32) are arranged at regular intervals in the axial direction of the flat tubes (31). Each of the fins (32) has a plurality of long narrow notches (32*a*) extending in the width direction of the fin (32) from an outer edge (i.e., a windward edge) of the fin (32). The plurality of notches (32*a*) are formed in the fin (32) at regular intervals in the longitudinal direction of the fins (32) (the vertical direction). A windward portion of each notch (32*a*) serves as a tube receiving portion (32*b*). The flat tube (31) is inserted in the tube receiving portion (32*b*), and is joined to a peripheral edge portion of the tube receiving portion (32*b*) by brazing. Further, the fin (32) is provided with louvers (32*c*) for promoting heat transfer.

As shown in FIG. 3, the windward bank (30) is divided into two heat exchange regions (35, 37) arranged one above the other. The upper heat exchange region serves as a principal windward heat exchange region (35), and the lower heat exchange region serves as an auxiliary windward heat exchange region (37). The number of the flat tubes (31) allocated to the auxiliary windward heat exchange region (37) is smaller than that of the flat tubes (31) forming the principal windward heat exchange region (35).

The principal windward heat exchange region (35) is divided into six vertically arranged, principal windward heat exchange sections (36). The auxiliary windward heat exchange region (37) is divided into six vertically arranged, auxiliary windward heat exchange sections (38). That is, the principal and auxiliary windward heat exchange regions (35) and (37) are each divided into the same number of heat exchange sections. Note that the number of the principal and auxiliary windward heat exchange sections (36) and (38) is merely an example, and is suitably two or more.

As shown in FIGS. 3 and 6, the principal windward heat exchange sections (36) each include the same number of flat tubes (31), e.g., six flat tubes (31). The number of the flat tubes (31) provided for each of the principal windward heat exchange sections (36) is merely an example, and may be two or more, or one.

As shown in FIGS. 3 and 5, the auxiliary windward heat exchange sections (38) each include the same number of flat tubes (31), e.g., two flat tubes (31). The number of the flat tubes (31) provided for each of the auxiliary windward heat exchange sections (38) is merely an example, and may be two or more, or one.

[Leeward Bank]

As shown in FIGS. 2, 4, and 5-10, the leeward bank (40) includes multiple flat tubes (41) and multiple fins (42).

Each of the flat tubes (41) is a heat transfer tube having a flat, substantially oval cross section when viewed in a section cut along a plane perpendicular to its axis (see FIG. 7). The plurality of flat tubes (41) are arranged such that upper and lower flat surfaces of each of the flat tubes face those of adjacent flat tubes. That is, the plurality of flat tubes (41) are vertically arranged at regular intervals, with their axes extending substantially parallel to each other.

As shown in FIG. 2, each of the flat tubes (41) includes a first leeward tube portion (41*a*) extending along the inner edge of the first windward tube portion (31*a*), a second leeward tube portion (41*b*) extending along the inner edge of the second windward tube portion (31*b*), a third leeward tube portion (41*c*) extending along the inner edge of the third windward tube portion (31*c*), and a fourth leeward tube portion (41*d*) extending along the inner edge of the fourth windward tube portion (31*d*). The flat tube (41) includes a first leeward bent portion (43*a*) which is bent horizontally at approximately right angles from the first leeward tube portion (41*a*) toward the second leeward tube portion (41*b*), a second leeward bent portion (43*b*) which is bent horizontally at approximately right angles from the second leeward tube portion (41*b*) toward the third leeward tube portion (41*c*), and a third leeward bent portion (43*c*) which is bent horizontally at approximately right angles from the third leeward tube portion (41*c*) toward the fourth leeward tube portion (41*d*).

An end of the first leeward tube portion (41*a*) of each of the flat tubes (41) is inserted in the third header collecting pipe (70), and an end of the fourth leeward tube portion (41*d*) is inserted in the fourth header collecting pipe (80) as shown in FIG. 4.

As shown in FIGS. 7-10, a plurality of refrigerant channels (C) are formed in each of the flat tubes (41). The plurality of refrigerant channels (C) extend in the axial direction of the flat tubes (41), and are aligned in the width direction of the flat tubes (41) (an air flow direction). Each of the refrigerant channels (C) opens at both end faces of an associated one of the flat tubes (41). A refrigerant supplied to the leeward bank (40) exchanges heat with air while flowing through the refrigerant channels (C) in the flat tubes (41). The plurality of refrigerant channels (C) in each of the flat tubes (41) of the leeward bank (40) constitute a set of leeward refrigerant channels (C2).

Each of the fins (42) is a vertically elongated plate fin formed by pressing a metal plate as shown in FIG. 7. The plurality of fins (42) are arranged at regular intervals in the axial direction of the flat tubes (41). Each of the fins (42) has a plurality of long narrow notches (42*a*) extending in the width direction of the fin (42) from an outer edge (i.e., a windward edge) of the fin (42*a*). The plurality of notches (42*a*) are formed in the fin (42) at regular intervals in the longitudinal direction of the fin (42) (the vertical direction). A windward portion of each notch (42*a*) serves as a tube receiving portion (42*b*). The flat tube (41) is inserted in the tube receiving portion (42*b*), and is joined to a peripheral edge portion of the tube receiving portion (42*b*) by brazing. Further, the fin (42) is provided with louvers (42*c*) for promoting heat transfer.

As shown in FIG. 4, the leeward bank (40) is divided into two heat exchange regions (45, 47) arranged one above the other. The upper heat exchange region serves as a principal leeward heat exchange region (45), and the lower heat exchange region serves as an auxiliary leeward heat exchange region (47). The number of the flat tubes (41) allocated to the auxiliary leeward heat exchange region (47) is smaller than that of the flat tubes (41) forming the principal leeward heat exchange region (45).

The principal leeward heat exchange region (45) is divided into six vertically arranged, principal leeward heat exchange sections (46). The auxiliary leeward heat exchange region (47) is divided into six vertically arranged, auxiliary leeward heat exchange sections (48). That is, the principal and auxiliary leeward heat exchange regions (45) and (47) are divided into the same number of heat exchange sections. Note that the number of the principal and auxiliary leeward heat exchange sections (46) and (48) is merely an example, and is suitably two or more.

As shown in FIG. 4, the principal leeward heat exchange sections (46) each include the same number of flat tubes (41), e.g., six flat tubes (41). The number of the flat tubes (41) provided for each of the principal leeward heat exchanger portions (46) is merely an example, and may be two or more, or one.

As shown in FIGS. 5 and 6, the auxiliary leeward heat exchange sections (48) each include the same number of flat tubes (41), e.g., two flat tubes (41). The number of the flat tubes (41) provided for each of the auxiliary leeward heat exchange sections (48) is merely an example, and may be two or more, or one.

[First Header Collecting Pipe]

As shown in FIGS. 2, 3, 5, and 8-10, the first header collecting pipe (50) is a cylindrical member with closed top and bottom. The first header collecting pipe (50) has a length (height) which is approximately the same as the heights of the windward and leeward banks (30) and (40).

As shown in FIGS. 3 and 5, the internal space of the first header collecting pipe (50) is horizontally divided into two by a principal divider (S1). The space above the principal divider (S1) is an upper windward space (52) corresponding to the principal windward heat exchange region (35). The space below the principal divider (S1) is a lower windward space (53) corresponding to the auxiliary windward heat exchange region (37). One end of a first principal gas pipe (52*a*) is connected to a vertical middle portion of the upper windward space (52). The other end of the first principal gas pipe (52*a*) communicates with the gas interconnecting pipe (14).

The lower windward space (53) is divided into six auxiliary windward spaces (55) by five dividers (54) vertically arranged at regular intervals. The six auxiliary windward spaces (55) respectively correspond to the six auxiliary windward heat exchange sections (38). The first windward tube portions (31*a*) of the two flat tubes (31), for example, communicate with an associated one of the auxiliary windward spaces (55).

[Second Header Collecting Pipe]

As shown in FIGS. 2, 3, 6, and 8-10, the second header collecting pipe (60) is a cylindrical member with closed top and bottom. The second header collecting pipe (60) has a length (height) which is approximately the same as the heights of the windward and leeward banks (30) and (40).

As shown in FIGS. 3 and 6, the internal space of the second header collecting pipe (60) is horizontally divided into two by a principal divider (61). The space above the principal divider (61) is an upper windward space (62) corresponding to the principal windward heat exchange region (35). The space below the principal divider (61) is a lower windward space (63) corresponding to the auxiliary windward heat exchange region (37).

The upper windward space (62) is divided into six principal windward communicating spaces (65) by five dividers (64) vertically arranged at regular intervals. The six principal windward communicating spaces (65) respectively correspond to the six principal windward heat exchange sections (36). The fourth windward tube portions (31*d*) of the six flat tubes (31), for example, communicate with an associated one of the principal windward communicating spaces (65).

The lower windward space (63) is divided into six auxiliary windward communicating spaces (67) by five dividers (66) vertically arranged at regular intervals. The six auxiliary windward communicating spaces (67) respectively correspond to the six auxiliary windward heat exchange sections (38). The fourth windward tube portions (31*d*) of the two flat tubes (31), for example, communicate with an associated one of the auxiliary windward communicating spaces (67).

Six windward communicating pipes (68) are connected to the second header collecting pipe (60). Each of the windward communicating pipes (68) connects associated ones of the ends of the flat tubes (31) in the principal windward heat exchange region (35) of the windward bank (30) and associated ones of the ends of the flat tubes (31) in the auxiliary windward heat exchange region (37).

Specifically, a first windward communicating pipe (68) connects the uppermost auxiliary windward communicating space (67) and the lowermost principal windward communicating space (65). A second windward communicating pipe (68) connects the second uppermost auxiliary windward communicating space (67) and the second lowermost principal windward communicating space (65). A third windward communicating pipe (68) connects the third uppermost auxiliary windward communicating space (67) and the third lowermost principal windward communicating space (65). A fourth windward communicating pipe (68) connects the fourth uppermost auxiliary windward communicating space (67) and the fourth lowermost principal windward communicating space (65). A fifth windward communicating pipe (68) connects the fifth uppermost auxiliary windward communicating space (67) and the fifth lowermost principal windward communicating space (65). A sixth windward communicating pipe (68) connects the lowermost auxiliary windward communicating space (67) and the uppermost principal windward communicating space (65).

[Third Header Collecting Pipe]

As shown in FIGS. 2, 4, and 8-10, the third header collecting pipe (70) is a cylindrical member with closed top and bottom. The third header collecting pipe (70) has a length (height) which is approximately the same as the heights of the windward and leeward banks (30) and (40).

The third header collecting pipe (70) has substantially the same internal configuration as the second header collecting pipe (60) shown in FIG. 6. Specifically, as shown in FIG. 4, the internal space of the third header collecting pipe (70) is horizontally divided into two by a principal divider (71). The space above the principal divider (71) is an upper leeward space (72) corresponding to the principal leeward heat exchange region (45). The space below the principal divider (71) is a lower leeward space (73) corresponding to the auxiliary leeward heat exchange region (47).

The upper leeward space (72) is divided into six principal leeward communicating spaces (75) by five dividers (74) vertically arranged at regular intervals. The six principal leeward communicating spaces (75) respectively correspond to the six principal leeward heat exchange regions (46). The first leeward tube portions (41*a*) of the six flat tubes (41), for example, communicate with an associated one of the principal leeward communicating spaces (75).

The lower leeward space (73) is divided into six auxiliary leeward communicating spaces (77) by five dividers (76) vertically arranged at regular intervals. The six auxiliary leeward communicating spaces (77) respectively correspond to the six auxiliary leeward heat exchange sections (48). The first leeward tube portions (41*a*) of the two flat tubes (41), for example, communicate with an associated one of the auxiliary leeward communicating spaces (77).

Six leeward communicating pipes (78) are connected to the third header collecting pipe (70). Each of the leeward communicating pipes (78) connects associated ones of the ends of the flat tubes (41) in the principal leeward heat exchange region (45) of the leeward bank (40) and associated ones of the ends of the flat tubes (41) in the auxiliary leeward heat exchange region (47).

Specifically, a first leeward communicating pipe (78) connects the uppermost auxiliary leeward communicating space (77) and the lowermost principal leeward communicating space (75). A second leeward communicating pipe (78) connects the second uppermost auxiliary leeward communicating space (77) and the second lowermost principal leeward communicating space (75). A third leeward communicating pipe (78) connects the third uppermost auxiliary leeward communicating space (77) and the third lowermost principal leeward communicating space (75). A fourth leeward communicating pipe (78) connects the fourth uppermost auxiliary leeward communicating space (77) and the fourth lowermost principal leeward communicating space (75). A fifth leeward communicating pipe (78) connects the fifth uppermost auxiliary leeward communicating space (77)

and the fifth lowermost principal leeward communicating space (75). A sixth leeward communicating pipe (78) connects the lowermost auxiliary leeward communicating space (77) and the uppermost principal leeward communicating space (75).

[Fourth Header Collecting Pipe]

As shown in FIGS. 2 and 4, the fourth header collecting pipe (80) is a cylindrical member with closed top and bottom. The fourth header collecting pipe (80) has a length (height) which is approximately the same as the heights of the windward and leeward banks (30) and (40).

The fourth header collecting pipe (80) has substantially the same internal configuration as the first header collecting pipe (50) shown in FIG. 5. Specifically, as shown in FIG. 4, the internal space of the fourth header collecting pipe (80) is horizontally divided into two by a principal divider (81). The space above the principal divider (81) is an upper leeward space (82) corresponding to the principal leeward heat exchange region (45). The space below the principal divider (81) is a lower leeward space (83) corresponding to the auxiliary leeward heat exchange region (47). One end of a second principal gas pipe (82*a*) is connected to a vertical middle portion of the upper leeward space (82). The other end of the second principal gas pipe (82*a*) communicates with the gas interconnecting pipe (14).

The lower leeward space (83) is divided into six auxiliary leeward spaces (85) by five dividers (84) vertically arranged at regular intervals. The six auxiliary leeward spaces (85) respectively correspond to the six auxiliary leeward heat exchange sections (48). The fourth leeward tube portions (41*d*) of the two flat tubes (41), for example, communicate with an associated one of the auxiliary leeward spaces (85).

[First Divergence Unit]

As shown in FIGS. 2 and 3, the first divergence unit (91) is attached to the first header collecting pipe (50). The first divergence unit (91) includes a cylindrical part (91*a*), six liquid connecting pipes (91*b*), and one first principal liquid pipe (91*c*).

The cylindrical part (91*a*) is a cylindrical member shorter in height than the first header collecting pipe (50), and stands upright along a lower portion of the first header collecting pipe (50). The six liquid connecting pipes (91*b*) are arranged in the vertical direction, and connected to the cylindrical part (91*a*). The number of the liquid connecting pipes (91*b*) is the same as that of the auxiliary windward communicating spaces (67) (six in this embodiment). The liquid connecting pipes (91*b*) respectively communicate with the windward auxiliary communicating spaces (67). One end of the first principal liquid pipe (91*c*) is connected to the lower portion of the cylindrical part (91*a*). The first principal liquid pipe (91*c*) and each of the liquid connecting pipes (91*b*) communicate with each other via a space inside the cylindrical part (91*a*). The other end of the first principal liquid pipe (91*c*) communicates with the liquid interconnecting pipe (13).

[Second Divergence Unit]

As shown in FIGS. 2 and 4, the second divergence unit (92) is attached to the fourth header collecting pipe (80). The second divergence unit (92) includes a cylindrical part (92*a*), six liquid connecting pipes (92*b*), and one second principal liquid pipe (92*c*).

The cylindrical part (92*a*) is a cylindrical member shorter in height than the fourth header collecting pipe (80), and stands upright along a lower portion of the fourth header collecting pipe (80). The six liquid connecting pipes (92*b*) are arranged in the vertical direction, and connected to the cylindrical part (92*a*). The number of the liquid connecting tubes (92*b*) is the same as that of the auxiliary leeward spaces (85) (six in this embodiment). The liquid connecting pipes (92*b*) respectively communicate with the leeward auxiliary spaces (85). One end of the second principal liquid pipe (92*c*) is connected to the lower portion of the cylindrical part (92*a*). The second principal liquid pipe (92*c*) communicates with the liquid connecting pipes (92*b*) via a space inside the cylindrical part (92*a*). The other end of the second principal liquid pipe (92*c*) communicates with the liquid interconnecting pipe (13).

—How Refrigerant Flows in Outdoor Heat Exchanger—

As shown in FIGS. 3, 4, 11, and 12, when the outdoor heat exchanger (23) functions as a condenser and an evaporator, the refrigerant in the flat tubes (31) of the windward bank (30) and the refrigerant in the flat tubes (41) of the leeward bank (40) flow in parallel with each other. Specifically, the outdoor heat exchanger (23) which functions as a condenser and an evaporator is configured to allow a refrigerant in the flat tubes (31) of the principal windward heat exchange region (35) of the windward bank (30) and a refrigerant in the flat tubes (41) of the principal leeward heat exchange region (45) of the leeward bank (40) to flow in parallel with each other, and also allow a refrigerant in the flat tubes (31) of the auxiliary leeward heat exchange region (37) of the windward bank (30) and a refrigerant in the flat tubes (41) of the auxiliary leeward heat exchange region (47) of the leeward bank (40) to flow in parallel with each other. That is, the outdoor heat exchanger (23) which functions as a condenser and an evaporator is configured to allow a refrigerant in the sets of windward refrigerant channels (C1) in the principal windward heat exchange region (35) to flow in parallel with a refrigerant in the sets of leeward refrigerant channels (C2) in the principal leeward heat exchange region (45).

Further, when the outdoor heat exchanger (23) functions a condenser and an evaporator, the refrigerant in the flat tubes (31) of the windward bank (30) and the refrigerant in the flat tubes (41) of the leeward bank (40) flow in opposite directions. Specifically, the outdoor heat exchanger (23) which functions as a condenser and an evaporator is configured to allow the refrigerant in the flat tubes (31) of the principal windward heat exchange region (35) of the windward bank (30) to flow in the opposite direction to the refrigerant in the flat tubes (41) of the auxiliary leeward heat exchange region (47) of the leeward bank (40). In other words, the outdoor heat exchanger (23) which functions as a condenser and an evaporator is configured to allow the refrigerant in the sets of windward refrigerant channels (C1) in the principal windward heat exchange region (35) to flow in the opposite direction to the refrigerant in the sets of leeward refrigerant channels (C2) in the principal leeward heat exchange region (45).

[When Outdoor Heat Exchanger Functions as Condenser]

During the cooling operation of the air conditioner (10), the indoor heat exchanger (25) functions as an evaporator, and the outdoor heat exchanger (23) functions as a condenser. In this section, it will be described how the refrigerant flows in the outdoor heat exchanger (23) during the cooling operation.

The gas refrigerant discharged from the compressor (21) is supplied to the outdoor heat exchanger (23) via the pipe (18). This refrigerant in the pipe (18) is diverged into the first and second principal gas pipes (52*a*) and (82*a*).

As shown in FIG. 3, the refrigerant supplied to the first principal gas pipe (52*a*) flows into the upper windward space (52) of the first header collecting pipe (50), and is distributed to the principal windward heat exchange sections (36). Flows of the refrigerant passing through the sets of windward refrigerant channels (C1) in the flat tubes (31) of each of the principal windward heat exchange sections (36) are condensed through dissipation of heat to the air. Thereafter, the flows of the refrigerant are respectively supplied to the principal windward communicating spaces (65) of the second header collecting pipe (60), and enter the windward communicating pipes (68). The flows of the refrigerant that have passed through the windward communicating pipes (68) are respectively supplied to the auxiliary windward communicating spaces (67) of the second header collecting pipe (60), and enter the auxiliary windward heat exchange sections (38). The flows of the refrigerant passing through the sets of windward refrigerant channels (C1) in the flat tubes (31) of each of the auxiliary windward heat exchange sections (38) are condensed through further dissipation of heat to the air, and supercooled (turn to a single liquid phase).

The flows of the supercooled liquid refrigerant are respectively supplied to the auxiliary windward spaces (55) of the first header collecting pipe (50), merge together in the first divergence unit (91), and the merged refrigerant is sent to the liquid interconnecting pipe (13) via the first principal liquid pipe (91*c*).

As shown in FIG. 4, the refrigerant supplied from the pipe (18) to the second principal gas pipe (82*a*) flows into the upper leeward space (82) of the fourth header collecting pipe (80), and is distributed to the principal leeward heat exchange sections (46). Flows of the refrigerant passing through the sets of leeward refrigerant channels (C2) in the flat tubes (41) of each of the principal leeward heat exchange sections (46) are condensed through dissipation of heat to the air. Thereafter, the flows of the refrigerant are respectively supplied to the principal leeward communicating spaces (75) of the third header collecting pipe (70), and enter the leeward communicating pipes (78). The flows of the refrigerant that have passed through the leeward communicating pipes (78) are supplied to the auxiliary leeward communicating spaces (77) of the third header collecting pipe (70), and enter the auxiliary leeward heat exchange sections (48). The flows of the refrigerant passing through the sets of leeward refrigerant channels (C2) in the flat tubes (41) of each of the auxiliary leeward heat exchange sections (48) are condensed through further dissipation of heat to the air, and supercooled (turn to a single liquid phase).

The flows of the supercooled liquid refrigerant are supplied to the auxiliary leeward spaces (85) of the fourth header collecting pipe (80), merge together in the second divergence unit (92), and the merged refrigerant is sent to the liquid interconnecting pipe (13) together with the refrigerant flowing out of the first divergence unit (91).

[When Outdoor Heat Exchanger Functions as Evaporator]

During the heating operation of the air conditioner (10), the indoor heat exchanger (25) functions as a condenser, and the outdoor heat exchanger (23) functions as an evaporator. In this section, it will be described how the refrigerant flows in the outdoor heat exchanger (23) during the heating operation.

A refrigerant, which has expanded while passing through the expansion valve (24) and turned into a two-phase gas and liquid refrigerant, is supplied to the outdoor heat exchanger (23) via the pipe (17). This refrigerant diverges from the pipe (17) into the first and second divergence units (91) and (92).

Figure 11:
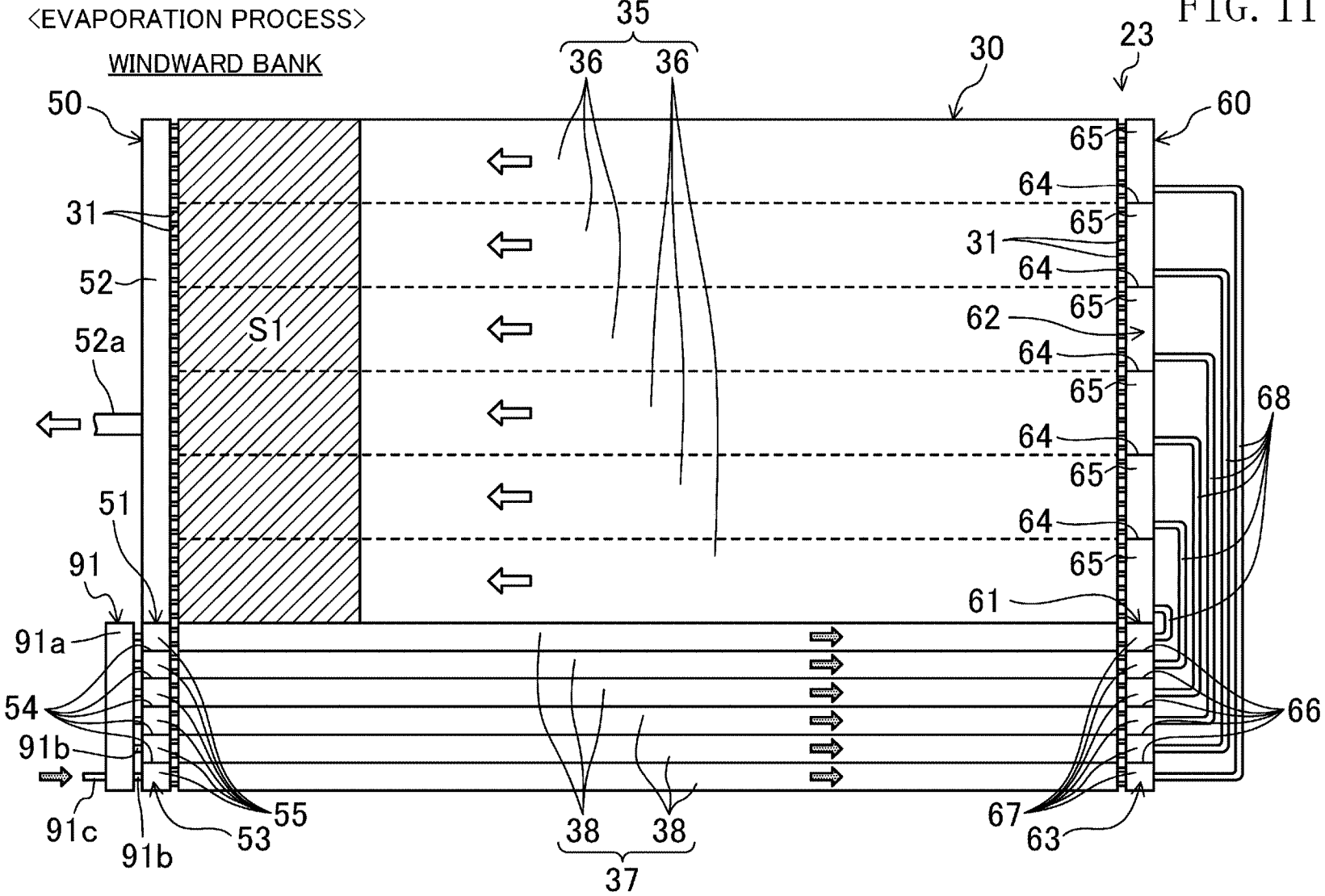
FIG. 11 is a schematic developed plan view showing the configuration of a windward bank of the outdoor heat exchanger, illustrating how a refrigerant flows when the heat exchanger functions as an evaporator.

As shown in FIG. 11, the refrigerant supplied to the first divergence unit (91) diverges into the liquid connecting pipes (91*b*), and is distributed to the auxiliary windward heat exchange sections (38) via the auxiliary windward spaces (55) of the first header collecting pipe (50). Flows of the refrigerant passing through the sets of windward refrigerant channels (C1) in the flat tubes (31) of each of the auxiliary windward heat exchange sections (38) evaporate through absorption of heat from the air. Thereafter, the flows of the refrigerant are respectively supplied to the auxiliary windward communicating spaces (67) of the second header collecting pipe (60), and enter the windward communicating pipes (68). The flows of the refrigerant that have passed through the windward communicating pipes (68) are supplied to the principal windward communicating spaces (65) of the second header collecting pipe (60), and enter the principal windward heat exchange sections (36). The flows of the refrigerant passing through the sets of windward refrigerant channels (C1) in the flat tubes (31) of each of the principal windward heat exchange sections (36) evaporate through further absorption of heat from the air, and superheated (turned to a single gas phase).

The flows of the superheated gas refrigerant merge together in the upper windward space (52) of the first header collecting pipe (50), and the merged refrigerant is sent to the gas interconnecting pipe (14) via the first principal gas pipe (52*a*).

Figure 12:
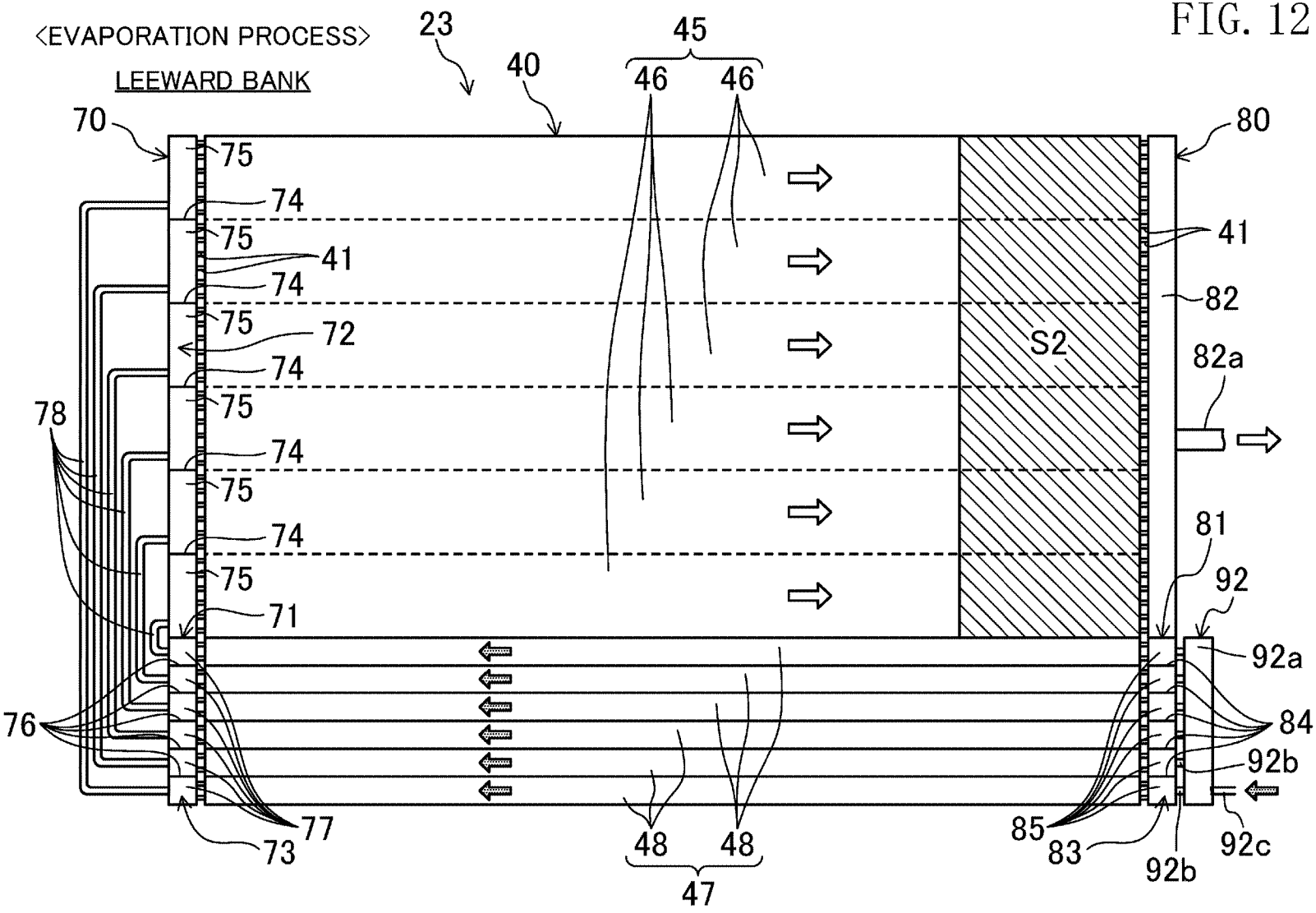
FIG. 12 is a schematic developed plan view showing the configuration of a leeward bank of the outdoor heat exchanger, illustrating how a refrigerant flows when the heat exchanger functions as an evaporator.

As shown in FIG. 12, the refrigerant supplied to the second divergence unit (92) diverges into the liquid connecting tubes (92*b*), and distributed to the auxiliary leeward heat exchange sections (48) via the auxiliary leeward spaces (85) of the fourth header collecting pipe (80). Flows of the refrigerant passing through the sets of leeward refrigerant channels (C2) in the flat tubes (41) of each of the auxiliary leeward heat exchange sections (48) evaporate through absorption of heat from the air. Thereafter, the flows of the refrigerant are supplied to the auxiliary leeward communicating spaces (77) of the third header collecting pipe (70), and enter the leeward communicating pipes (78). The flows of the refrigerant that have passed through the leeward communicating pipes (78) are supplied to the principal leeward communicating spaces (75) of the third header collecting pipe (70), and enter the principal leeward heat exchange sections (46). The flows of the refrigerant passing through the set of leeward refrigerant channels (C2) in each of the flat tubes (41) of the principal leeward heat exchange sections (46) evaporate through further absorption of heat from the air, and superheated (turned to a single gas phase).

The flows of the superheated gas refrigerant merge together in the upper leeward space (72) of the fourth header collecting pipe (80), and the merged refrigerant is sent to the gas interconnecting pipe (14) together with the refrigerant flowing out of the first principal gas pipe (52*a*).

<How to Reduce Drift of Air>

When the outdoor heat exchanger (23) functions as an evaporator, there has been a problem that the air flowing through the outdoor heat exchanger (23) tends to drift. Specifically, in the outdoor heat exchanger (23), each of the two banks (30, 40) is provided with the sets of refrigerant channels (C1, C2), and refrigerants in the sets of refrigerant channels (C1, C2) are allowed to flow in parallel with each other. In each of the sets of refrigerant channels (C1, C2), the two-phase gas and liquid refrigerant is used to cool the air. Thus, moisture in the air may sometimes be condensed to frost the surfaces of the flat tubes (31, 41) and fins (32, 42).

On the other hand, when the two-phase gas and liquid refrigerant further evaporates in each set of refrigerant channels (C1, C2), the refrigerant becomes superheated to raise the temperature. Thus, moisture in the air is not easily condensed in a portion of the flat tubes (31, 41) where the superheated refrigerant flows, thus almost eliminating frost from the surfaces of the flat tubes (31, 41) and fins (32, 42).

For these reasons, when the liquid, or two-phase gas and liquid refrigerant flows through a portion of one of adjacent sets of refrigerant channels (C1, C2), and the superheated refrigerant flows through a portion of the other set of refrigerant channels (C1, C2), the former and latter portions may overlap with each other in the air flow direction. In that case, the air flowing through the outdoor heat exchanger (23) tends to drift.

Specifically, for example, when a portion of one of two adjacent sets of refrigerant channels (C1, C2) and a portion of the other set of refrigerant channels (C1, C2), through each of which the liquid, or two-phase gas and liquid refrigerant flows, overlap with each other in the air flow direction, the surfaces of the flat tubes (31, 41) and fins (32, 42) corresponding to these portions tend to be frosted as described above. In particular, water condensed on the surfaces of the flat tubes (31, 41) tends to stagnate there. Thus, the amount of frost on the surfaces tends to increase. In such a state, the flat tubes (31, 41) and fins (32, 42) of both of the windward and leeward banks (30) and (40) will be continuously frosted. As a result, the ventilation resistance tends to increase around the frosted flat tubes and fins.

In contrast, when a portion of one of the adjacent sets of refrigerant channels (C1, C2) and a portion of the other set of refrigerant channels (C1, C2), through each of which the superheated refrigerant flows, overlap with each other in the air flow direction, the surfaces of the flat tubes (31, 41) and fins (32, 42) corresponding to these portions are hardly frosted. Thus, in such a state, the ventilation resistance around the superheated portions overlapping with each other in two banks becomes lower than anywhere else, allowing the air to drift more easily around the superheated portions.

If the drift of the air occurs in this way, not all of the flat tubes (31, 41) and fins (32, 42) of the outdoor heat exchanger (23) can be effectively used for heat transfer between the refrigerant and the air. This leads to a decrease in heat exchange efficiency. According to this embodiment, superheated regions (S1, S2) of the banks (30, 40) are configured not to overlap with each other in the air flow direction so as to substantially prevent the drift of the air.

Figure 13:
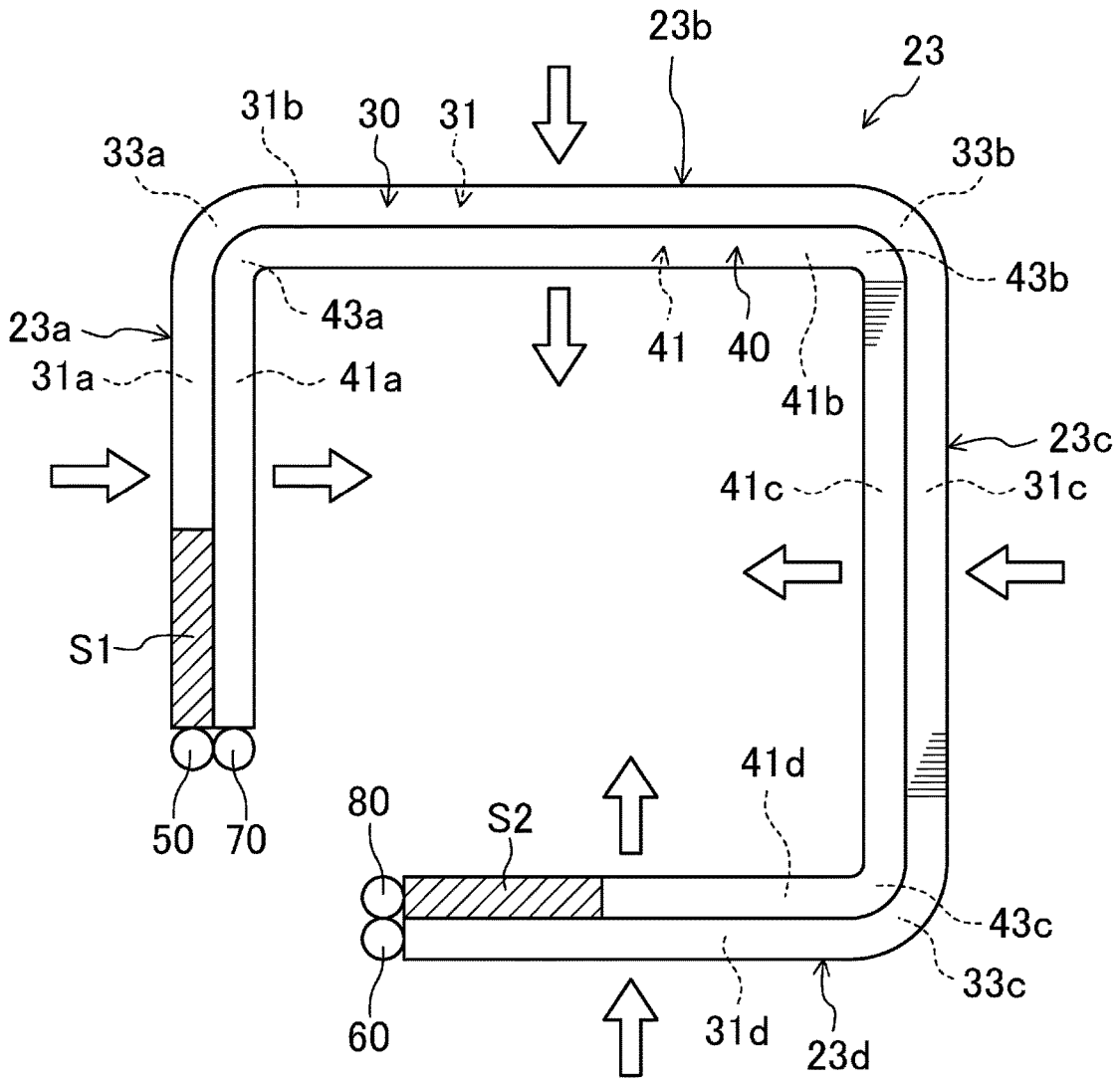
FIG. 13 is a schematic top view illustrating the outdoor heat exchanger functioning as an evaporator.

Specifically, as shown in FIGS. 11-13, in the outdoor heat exchanger (23), the refrigerant in the sets of windward refrigerant channels (C1) and the refrigerant in the sets of leeward refrigerant channels (C2) flow in opposite directions as described above. Thus, the superheated region (S1) of the windward bank (30) is formed near an end of each of the first windward tube portions (31*a*) of the flat tubes (31), while the superheated region (S2) of the leeward bank (40) is formed near an end of each of the fourth leeward tube portions (41*d*) of the flat tubes (41). That is, the superheated regions (S1) and (S2) are disposed most distant from each other in the longitudinal direction of the flat tubes (31, 41). This can effectively prevent the superheated regions (S1) and (S2) from overlapping with each other in the air flow direction, and also eliminate the above-described drift of the air.

In the outdoor heat exchanger (23), various parameters, such as the number and size of the flat tubes (31, 41), the number and size of the refrigerant channels (C), the amount of the refrigerant circulating, and the volume of the air, are set to substantially prevent the superheated regions (S1) and (S2) from overlapping with each other in the air flow direction.

Advantages of Embodiment

The embodiment achieves the following advantages and effects.

When the outdoor heat exchanger (23) functions as an evaporator, the superheated regions (S1, S2), in which the superheated refrigerants flow, in a pair of the sets of refrigerant channels (C1, C2) adjacent to each other in the air flow direction do not overlap with each other in the air flow direction. Thus, the biased drift of the air only toward the superheated regions (S1, S2) can be prevented. As a result, even if frosting occurs on the surfaces of the flat tubes (31, 41) and fins (32, 42) other than the superheated regions (S1, S2), the air can still flow uniformly throughout the outside heat exchanger (23). This improves the heat exchange efficiency, and eventually the evaporation performance, of the heat exchanger.

The refrigerants in the adjacent sets of refrigerant channels (C1, C2) flow in parallel with each other. Thus, compared to the case where the refrigerants in the adjacent sets of refrigerant channels (C1, C2) flow in series, the total length of the refrigerant channels (C) is reduced, thereby reducing the flow velocity of the refrigerant as well. This can reduce the pressure loss in the refrigerant channels (C).

The flat tubes (31, 41) are arranged in two banks. Thus, the width (length in the air flow direction) of the flat tubes (31, 41) can be relatively reduced. This facilitates the bending of the bent portions (33*a*, 33*b*, 33*c*, 43*a*, 43*b*, 43*c*) of the flat tubes (31, 41) in the width direction. Reducing the width of the flat tubes (31, 41) allows the ventilation resistance between the flat tubes (31, 41) of each bank (30, 40) to be reduced, thus curbing a decline in thermal transmittance. Further, the decrease in the width of the flat tubes (31, 41) also precludes the possibility of condensed water stagnating on the flat tubes (31, 41). This substantially prevents the surfaces of the flat tubes (31, 41) from being frosted.

The outdoor heat exchanger (23) is configured as a so-called "four-surface heat exchanger." Thus, the heat exchanger can be downsized, and the area of a heating surface that contributes to heat exchange between the air and the refrigerant can be ensured. Further, in the adjacent sets of refrigerant channels (C1, C2), a sufficient distance is ensured between the superheated regions (S1, S2). This can effectively prevent the superheated regions (S1, S2) from overlapping with each other.

Alternative Examples of Embodiment

As shown in FIG. 7, the outdoor heat exchanger (23) of the above-described embodiment is a double-bank heat exchanger including the windward and leeward banks (30, 40), each having the flat tubes (31, 41). Specifically, in the outdoor heat exchanger (23), the set of windward refrigerant channels (C1) is formed in each of the flat tubes (31) of the windward bank (30), and the leeward set of refrigerant channels (C2) is formed in each of the flat tubes (41) of the leeward bank (40). However, as in an alternative example shown in FIG. 14, the flat tubes (31) may be arranged only in a single bank, and two or more sets of refrigerant channels (C1, C2) (two sets in this example) may be arranged side by side in the air flow direction in each of the flat tubes (31). Also in this configuration, the refrigerant in the set of windward refrigerant channels (C1) and the refrigerant in the set of leeward refrigerant channels (C2) are allowed to flow in parallel with each other, and in opposite directions when the heat exchanger functions as an evaporator. Thus, as described in the above-described embodiment, the superheated regions (S1, S2) do not overlap with each other in the air flow direction, thereby substantially preventing the drift of the air.

Figure 14:
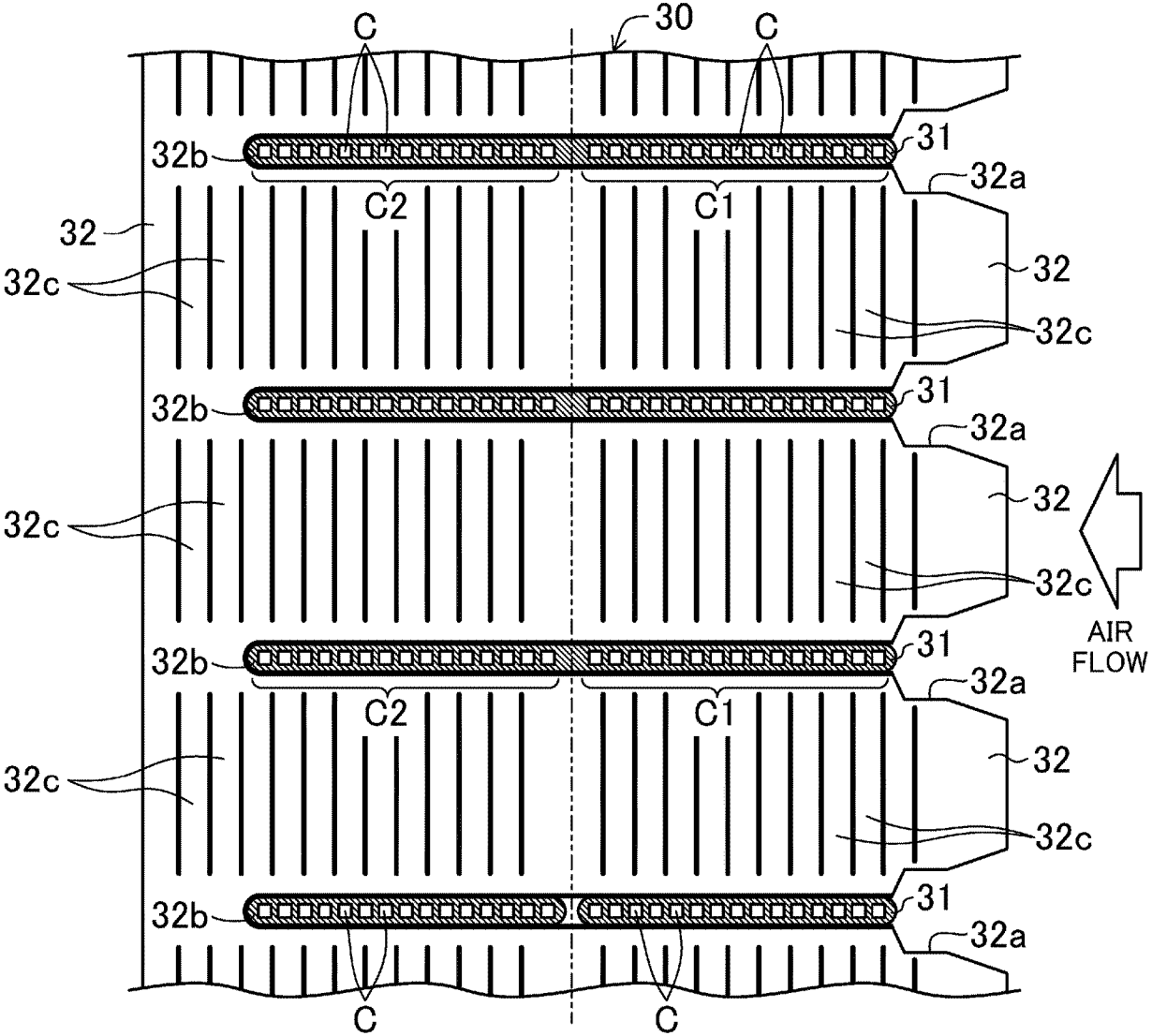
FIG. 14 is a view corresponding to FIG. 7, illustrating an alternative example of the embodiment.

Further, in the alternative example, the flat tubes (31) and the fins (32) are arranged only in a single bank as shown in FIG. 14. This can reduce the parts count.

Other Embodiments

The embodiment of the present disclosure may be modified in the following manner.

In the outdoor heat exchanger (23), each adjacent pair of the header collecting pipes (50, 70) and (60, 80) is comprised of two separate members. Alternatively, at least one pair of these header collecting pipes may be configured as a single member, and the internal space thereof may be divided into two.

In the outdoor heat exchanger (23), the superheated regions (S1, S2) of the sets of refrigerant channels (C1, C2) adjacent to each other in the two banks of the flat tubes (31, 41) do not overlap with each other. Alternatively, each adjacent pair of the superheated regions among three or more sets of refrigerant channels (C1, C2), for example, may be configured not to overlap with each other.

The auxiliary heat exchange regions (37, 47) of the outdoor heat exchanger (23) may be omitted.

The heat exchanger of the present disclosure is implemented as the outdoor heat exchanger (23). Alternatively, the heat exchanger of the present disclosure may also be implemented as the indoor heat exchanger (25). In such a case, the indoor heat exchanger (25) is suitably a four-surface heat exchanger built in a ceiling-mounted, or -suspended indoor unit, for example. The outdoor and indoor heat exchangers (23) and (25) do not necessarily have four surfaces, but may have three surfaces or less.

Figure 15:
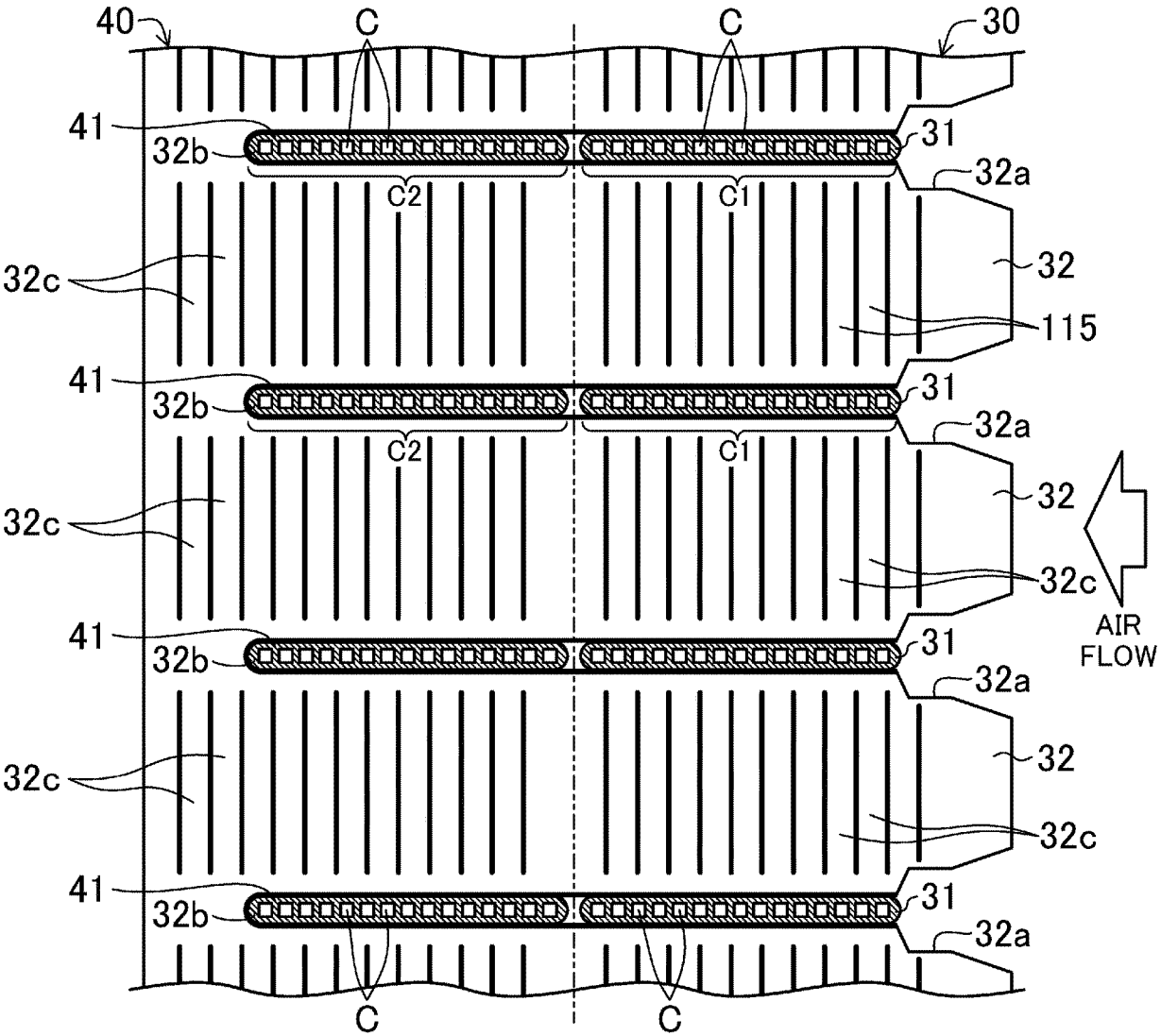
FIG. 15 is a view corresponding to FIG. 7, illustrating an outdoor heat exchanger according to another embodiment.

The heat exchanger of the present disclosure has, as shown in FIG. 7, for example, the fins (32, 42) separately provided on the windward and leeward sides for the windward and leeward banks (30) and (40), respectively. Alternatively, as shown in FIG. 15, for example, the flat tubes (31, 41) may form two banks, and the windward and leeward fins (32, 42) may be configured as a single fin covering both of the windward and leeward banks (30) and (40).

Each of the fins (32, 42) of the heat exchanger of the present disclosure is provided with the tube receiving portions (32*b*, 42*b*) extending from a windward edge portion, and the flat tubes (31, 41) are inserted in the tube receiving portions (32*b*, 42*b*). Alternatively, the heat exchanger may be configured such that the tube receiving portions are formed to extend from a leeward edge portion of the fin (32, 42), and the flat tubes (31, 41) may be inserted in the tube receiving portions. Further, each of the fins (32, 42) of the present disclosure is provided with the louvers (32*c*, 42*c*) as heat transfer accelerators. Alternatively, bulges (projections) protruding from the fins (32, 42) in the thickness direction, slits, or any other suitable feature may be provided as the heat transfer accelerator.

The two banks (30, 40) of the above-described embodiments may have different configurations. Specifically, the flat tubes (31, 41) disposed in two banks, for example, may have different widths, may be arranged at different intervals in the thickness direction (the vertical direction), and may have the refrigerant channels (C) of different channel areas and in different numbers. Moreover, the fins (32, 42) disposed in two banks may have different widths (lengths measured in the air flow direction), may be arranged at different pitches (intervals) in the thickness direction of the fins (32, 42), or may have different shapes.

In the air conditioner of the present disclosure, a refrigerant regulating valve may be provided for each of the plurality of banks (30, 40). Specifically, if the degrees of opening of the refrigerant regulating valves are controlled separately, the amounts of refrigerants flowing in parallel into the banks (30, 40) may be separately controlled.

INDUSTRIAL APPLICABILITY

As can be seen from the foregoing description, the present invention is useful for a heat exchanger and an air conditioner.

DESCRIPTION OF REFERENCE CHARACTERS

10 Air Conditioner
23 Outdoor Heat Exchanger (Heat Exchanger)
23*a* First Side Surface (Side Surface)
23*b* Second Side Surface (Side Surface)
23*c* Third Side Surface (Side Surface)
23*d* Fourth Side Surface (Side Surface)
30 Windward Bank (Bank)
31 Flat Tube
32 Fin
33*a* First Windward Bent Portion (Bent Portion)
33*b* Second Windward Bent Portion (Bent Portion)
33*c* Third Windward Bent Portion (Bent Portion)
43*a* First Leeward Bent Portion (Bent Portion)
43*b* Second Leeward Bent Portion (Bent Portion)
43*c* Third Leeward Bent Portion (Bent Portion)
40 Leeward Bank (Bank)
41 Flat Tube
42 Fin
C Refrigerant Channel
C1 Set of Windward Refrigerant Channels
C2 Set of Leeward Refrigerant Channels
S1 Superheated Region
S2 Superheated Region

The invention claimed is:

1. A heat exchanger, comprising:

a plurality of flat tubes arranged parallel to each other, in each of which a plurality of refrigerant channels are formed; and fins joined to the flat tubes, the heat exchanger allowing a refrigerant flowing through each of the refrigerant channels to exchange heat with air, wherein the plurality of refrigerant channels includes: a set of windward refrigerant channels arranged on a windward side in an air flow direction and a set of leeward refrigerant channels arranged on a leeward side in the air flow direction, a windward bank having a plurality of flat tubes corresponding to the windward refrigerant channels and being arranged on the windward side in the air flow direction;

a leeward bank having a plurality of flat tubes corresponding to the leeward refrigerant channels and being arranged on the leeward side in the air flow direction, the windward bank is provided with a principal windward heat exchange region including two or more of the flat tubes, and an auxiliary windward heat exchange region including a smaller number of the flat tubes than the principal windward heat exchange region, the leeward bank is provided with a principal leeward heat exchange region including two or more of the flat tubes, and an auxiliary leeward heat exchange region including a smaller number of the flat tubes than the principal leeward heat exchange region, a first gas pipe connected to the flat tubes in the principal windward heat exchange region and a first liquid pipe connected to the flat tubes in the auxiliary windward heat exchange region are arranged adjacent to one side end of the windward bank, windward communicating pipes each connecting associated ones of the flat tubes in the principal windward heat exchange region and associated ones of the flat tubes in the auxiliary windward heat exchange region are arranged adjacent to an other side end of the windward bank, a second gas pipe connected to the flat tubes in the principal leeward heat exchange region and a second liquid pipe connected to the flat tubes in the auxiliary leeward heat exchange region are arranged adjacent to one side end of the leeward bank, leeward communicating pipes each connecting associated ones of the flat tubes in the principal leeward heat exchange region and associated ones of the flat tubes in the auxiliary leeward heat exchange region are arranged adjacent to an other side end of the leeward bank, and when the heat exchanger functions as an evaporator and when the heat exchanger functions as a condenser, the refrigerant in the flat tubes in the principal windward heat exchange region and the refrigerant in the flat tubes in the principal leeward heat exchange region flow in parallel to each other and in opposite directions, and the refrigerant in the flat tubes in the auxiliary windward heat exchange region and the refrigerant in the flat tubes in the auxiliary leeward heat exchange region flow in parallel with each other and in opposite directions.

2. The heat exchanger of claim 1, wherein superheated refrigerant regions in the set of windward refrigerant channels and the set of leeward refrigerant channels do not overlap with each other in the air flow direction.

3. The heat exchanger of claim 1, wherein the plurality of flat tubes are vertically arranged, each of the flat tubes has three bent portions, and four side surfaces through which the air passes are formed by the plurality of flat tubes.

4. An air conditioner, comprising:

a refrigerant circuit which includes the heat exchanger of claim 1, and performs a refrigeration cycle, wherein the air conditioner is switchable between an operation in which the heat exchanger functions as an evaporator, and an operation in which the heat exchanger functions as a condenser.

5. The heat exchanger of claim 1, wherein the principal windward heat exchange region of the windward bank and the auxiliary leeward heat exchange region of the leeward bank are configured not to overlap with each other in the air flow direction, and the auxiliary windward heat exchange region of the windward bank and the principal leeward heat exchange region of the leeward bank are configured not to overlap with each other in the air flow direction.

6. The heat exchanger of claim 1, wherein a superheated region of the principal windward heat exchange region of the windward bank and a superheated region of the principal leeward heat exchange region of the leeward bank are configured not to overlap with each other in the air flow direction.

7. The heat exchanger of claim 6, wherein the plurality of flat tubes are vertically arranged, each of the flat tubes has three bent portions, and four side surfaces through which the air passes are formed by the plurality of flat tubes.

8. The heat exchanger of claim 7, wherein the four side surfaces are arranged in the shape of a rectangle, space is formed between two of the four side surfaces formed by the plurality of flat tubes, and the first gas pipe, the second gas pipe, the first liquid pipe, the second liquid pipe, the windward communicating pipes, and the leeward communicating pipes are arranged in the space.

9. The heat exchanger of claim 1, wherein the windward bank is provided with a first header collecting pipe to which the plurality of flat tubes are connected, the leeward bank is provided with a fourth header collecting pipe to which the plurality of flat tubes are connected, and the heat exchanger further comprises a first divergence unit having a cylindrical shape, standing upright along the first header collecting pipe, and attached to the first header collecting pipe, and a second divergence unit having a cylindrical shape, standing upright along the fourth header collecting pipe, and attached to the fourth header collecting pipe.

10. The heat exchanger of claim 1, wherein each of the fins has a plurality of tube receiving portions in each of which the flat tube is inserted, the tube receiving portions being formed at an outer edge of the fin corresponding to an outer side of the heat exchanger, and inner edges of the fins corresponding to an inner side of the heat exchanger are continuous in a direction of arrangement of the flat tubes.

11. The heat exchanger of claim 10, wherein the plurality of flat tubes are vertically arranged, each of the flat tubes has three bent portions, and four side surfaces through which the air passes are formed by the plurality of flat tubes.

* * * * *